US006622410B2

(12) United States Patent
Wilkes et al.

(10) Patent No.: US 6,622,410 B2
(45) Date of Patent: Sep. 23, 2003

(54) ATTACHMENT BRACKET FOR A SHELF-EDGE DISPLAY SYSTEM

(75) Inventors: Derek Alan Wilkes, Half Moon Bay, CA (US); Thomas R. Kruer, Edgewood, KY (US); David Kenneth Memke, Cincinnati, OH (US); Jon Charles Heisler, New Carlisle, OH (US); William H. McMahon, Ludlow Falls, OH (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/253,338

(22) Filed: Feb. 19, 1999

(65) Prior Publication Data

US 2002/0146282 A1 Oct. 10, 2002

Related U.S. Application Data

(60) Provisional application No. 60/075,381, filed on Feb. 20, 1998.

(51) Int. Cl.[7] ..... G09F 3/20

(52) U.S. Cl. ..... 40/654; 40/649; 40/653; 40/661.03

(58) Field of Search ..... 40/124.05, 642.02, 40/649, 651, 653, 654, 661.03

(56) References Cited

U.S. PATENT DOCUMENTS

| | | | |
|---|---|---|---|
| 1,282,560 | A | 10/1918 | Fingler et al. |
| 2,362,273 | A | 11/1944 | Hopp |
| 2,827,718 | A | 3/1958 | Howard |

(List continued on next page.)

FOREIGN PATENT DOCUMENTS

| | | |
|---|---|---|
| BE | 648368 | 9/1964 |
| EP | 299355 A2 | 7/1988 |
| EP | 722158 A1 | 7/1996 |
| GB | 2207539 | 2/1989 |
| GB | 2249854 | 5/1992 |
| WO | 9307785 | 4/1993 |
| WO | 9319448 | 9/1993 |
| WO | 9400895 | 1/1994 |
| WO | 9422125 | 9/1994 |
| WO | 9506935 | 3/1995 |
| WO | 9609619 | 3/1996 |
| WO | 9614630 | 5/1996 |
| WO | 9720437 | 6/1997 |
| WO | 9748862 | 12/1997 |

OTHER PUBLICATIONS

Specification for currently pending patent application Ser. No. 09/118,610 filed Jul. 17, 1998 for Article–Information Display System Using Electronically Controlled Tags.

Specification for currently pending patent application Ser. No. 09/118,357 filed Jul. 17, 1998 for Article–Information Display System Using Electronically Controlled Tags.

Specification for currently pending patent application Ser. No. 09/118,607 filed Jul. 17, 1998 for Article–Information Display System Using Electronically Controlled Tags.

(List continued on next page.)

*Primary Examiner*—Lynne H. Browne
*Assistant Examiner*—James M. Hewitt
(74) *Attorney, Agent, or Firm*—Thompson Hine LLP

(57) ABSTRACT

An adapter clip for receiving an auxiliary rail having an upper slot and a lower slot, the adapter clip being shaped to be received in a shelf edge having an upper and lower groove. The adapter clip includes an upper flange and a lower flange, the upper and lower flanges being shaped to be received in the upper and lower groove, respectively, to thereby couple the adapter clip to the shelf edge. The adapter clip further includes an upper tang and a lower tang, the upper and lower tangs being shaped to be received in the upper and lower slot, respectively, to thereby couple the adapter clip to the auxiliary rail.

38 Claims, 31 Drawing Sheets

U.S. PATENT DOCUMENTS 3,014,294 A 12/1961 Singer ..... 40/5
3,015,177 A 1/1962 Hembd et al.
3,084,463 A 4/1963 Guyer et al.
3,086,308 A 4/1963 Ternouth
3,089,211 A 5/1963 Perusse ..... 24/259
3,815,519 A 6/1974 Meyer ..... 108/61
3,889,408 A 6/1975 Offner
3,918,668 A 11/1975 Thorpe ..... 248/205
3,955,296 A 5/1976 Kapstad
4,002,886 A 1/1977 Sundelin ..... 235/61.7
4,155,091 A 5/1979 Vorie ..... 343/728
4,167,073 A 9/1979 Tang ..... 40/124.1
4,179,138 A 12/1979 Bogdanovic ..... 281/15
4,301,987 A 11/1981 Conway ..... 248/221.4
4,346,453 A 8/1982 Drapeau et al. ..... 364/900
4,426,797 A * 1/1984 Burkemper et al. ..... 40/651
4,450,955 A * 5/1984 Featherston ..... 40/649
4,500,880 A 2/1985 Gomersall et al. ..... 340/825.35
4,531,311 A 7/1985 Howard et al.
4,556,183 A 12/1985 Greenberger ..... 248/221.4
4,562,657 A 1/1986 Murray ..... 40/518
4,606,280 A 8/1986 Poulton et al. ..... 108/97
4,694,600 A 9/1987 Murray ..... 40/518
4,745,695 A 5/1988 Hetzer
4,798,014 A 1/1989 Stoerzinger et al.
4,805,331 A 2/1989 Boggess et al. ..... 40/651
4,871,135 A 10/1989 Thalenfeld ..... 248/221.4
4,881,707 A 11/1989 Garfinkle ..... 248/221.4
4,888,709 A 12/1989 Revesz et al. ..... 364/518
4,899,974 A 2/1990 Wear et al. ..... 248/467
4,939,861 A 7/1990 Soubliere ..... 40/651
4,962,466 A 10/1990 Revesz et al. ..... 364/518
5,044,104 A 9/1991 Hopperdietzel
5,111,196 A 5/1992 Hunt ..... 340/825.35
5,198,644 A 3/1993 Pfeiffer et al. ..... 235/383
5,233,773 A 8/1993 Reynolds
5,241,467 A 8/1993 Failing et al. ..... 364/401
5,289,652 A 3/1994 Kringel et al.
5,332,108 A 7/1994 Blass ..... 211/90
5,348,485 A 9/1994 Briechle et al. ..... 439/110
D351,191 S 10/1994 Barocas et al. ..... D18/56
5,374,815 A 12/1994 Waterhouse et al. ..... 235/383
5,406,271 A 4/1995 Sonnendorfer et al. 340/825.35
5,419,066 A * 5/1995 Harnois et al. ..... 40/642.02
5,420,606 A 5/1995 Begum et al. ..... 345/156
5,442,343 A 8/1995 Cato et al. ..... 340/825.35
5,448,226 A 9/1995 Failing, Jr. et al. ..... 340/825.35
5,461,809 A 10/1995 Fowler et al.
5,465,085 A 11/1995 Caldwell et al. ..... 340/825.35
5,467,474 A 11/1995 Ackerman et al. ..... 395/800
5,473,832 A 12/1995 Briechle et al.
5,473,833 A 12/1995 Ostrovsky
5,488,793 A * 2/1996 Gebka et al. ..... 40/642.02
5,532,465 A * 7/1996 Waterhouse et al. ..... 235/383
5,535,969 A 7/1996 Duffy, Jr. ..... 248/68.1
5,537,126 A 7/1996 Kayser et al. ..... 345/1
5,539,393 A 7/1996 Barfod ..... 340/825.52
5,548,282 A 8/1996 Escritt et al. ..... 340/825.35
5,553,412 A 9/1996 Briechle et al.
5,564,210 A 10/1996 Hetzer et al. ..... 40/649
5,575,100 A 11/1996 Marvin et al.
5,583,487 A 12/1996 Ackerman et al. ..... 340/825.35
5,611,512 A 3/1997 Cholet ..... 248/220.22
5,668,560 A 9/1997 Evans et al. ..... 343/702
5,736,967 A 4/1998 Kayser et al. ..... 345/1
5,791,080 A 8/1998 Hamano ..... 40/642.02
6,035,569 A * 3/2000 Nagel et al. ..... 40/661.03
6,092,320 A * 7/2000 Bringuet ..... 40/661.03 X

OTHER PUBLICATIONS

Specification for currently pending patent application Ser. No. 09/118,606 filed Jul. 17, 1998 for Article–Information Display System Using Electronically Controlled Tags.
Specification for currently pending patent application Ser. No. 09/120,769 filed Jul. 22, 1998 for Article–Information Display System Using Electronically Controlled Tags.
Specification for currently pending patent application Ser. No. 09/118,653 filed Jul. 17, 1998 for Article–Information Display System Using Electronically Controlled Tags.
Specification for currently pending patent application Ser. No. 09/118,423 filed Jul. 17, 1998 for Article–Information Display System Using Electronically Controlled Tags.
PCT International Search Report; PCT/US 99/03758; filed on Feb. 19, 1999.
Written Opinion regarding corresponding International Application No. PCT/US99/03758 (issued Dec. 20, 2000).

* cited by examiner

ATTACHMENT BRACKET FOR A SHELF-EDGE DISPLAY SYSTEM

This application claims priority to U.S. Provisional Application No. 60/075,381, filed Feb. 20, 1998.

FIELD OF THE INVENTION

The present invention is directed to an article information display system and, more particularly, to a bracket for receiving a rail such that the bracket and rail may be attached to a shelf edge.

BACKGROUND OF THE INVENTION

Article information display systems may be used to electronically provide information about an associated product. The system typically utilizes price tags having a variable display surface, such as an LCD (liquid crystal display) surface, to electronically display information about the product. For example price, price per unit weight, and other such information may be displayed. Such a system may be used in supermarkets, drug stores, grocery stores, hardware stores, auto parts stores, or other settings where variable article information is desired to be displayed.

The article information display system reduces the labor that is required to update the information on the tags, and diminishes the chances of displaying an incorrect price due to human error. Furthermore, the electronic article information display system facilitates the changing of a large number of prices at once, as all of the prices may be controlled and changed at a central computer. Furthermore, the check out counters in an establishment utilizing the shelf edge display system may be electronically linked to the same computer that controls the display tags, which ensures that there are no discrepancies between the displayed price and the price registered at the checkout counters.

In order to install such a display system, an auxiliary rail that is designed to interact with an electronic display tag is mounted to the store shelving units. To mount the auxiliary rails, existing store shelves may be disassembled and a customized shelf edge display system installed in its place. However, it is quicker, easier and more economical to retrofit the auxiliary rail to an existing conventional shelf edge. It has been found that several difficulties may arise in attempting to mount such an auxiliary rail to existing shelf edges. For example, there are a number of differing types and shapes of shelf edges that must be accommodated. Furthermore, the rail must be securely mounted to the shelf edge, as the mounted rail should be able to withstand forces that tend to pull the auxiliary rail away from the shelf edge. These forces may applied by products located on the shelves, customers, or by other means.

Accordingly, there is a need for an adaptive interface which can be used in conjunction with various conventional shelf edge designs, which can be securely mounted to the shelf edge and securely receive an auxiliary rail therein, and which provides a standard base upon which a rail system for an electronic display system may be mounted.

SUMMARY OF THE INVENTION

The present invention is an adapter clip that enables the installation of auxiliary rails and other components of the electronic display tag system onto conventional, preexisting store shelving assemblies. The adapter clip eliminates the need for substantial modification to the preexisting shelving assemblies, does not require removal of the products from the shelves, and does not require the use of complex tooling or a significant amount of manpower. The clip can fit into a wide range of shelf edges, and can be held securely to the shelf edge and to the auxiliary rail. In one embodiment, the invention is an adapter clip for receiving an auxiliary rail having an upper slot and a lower slot, the adapter clip being shaped to be received in a shelf edge having an upper and lower groove. The adapter clip comprises an upper flange and a lower flange, the upper and lower flanges being shaped to be received in the upper and lower groove, respectively, to thereby couple the adapter clip to the shelf edge. The adapter clip further comprises an upper tang and a lower tang, the upper and lower tangs being shaped to be received in the upper and lower slot, respectively, to thereby couple the adapter clip to the auxiliary rail.

The present invention is also a rail for receiving a tag therein, wherein the rail includes one or more raised protrusions to block the tag from substantially sliding with the rail. In one embodiment, the invention is a rail for receiving a display tag therein comprising a backing having a top edge and a bottom edge. The rail further includes an upper flange extending from the top edge and a lower flange extending from the bottom edge, the upper and lower flanges defining a channel therebetween for receiving the tag therein, and a protrusion extending into the channel to block significant lateral movement of the tag when the tag is received in the rail.

The present invention is also a rail for receiving a tag therein such that the tag is properly located in the rail to ensure proper inductive coupling between the rail and the tag. In one embodiment, the invention is a rail for receiving a display tag therein, the display tag having a conductive coil having an upper portion and a lower portion. The rail receives a conductive loop having an upper portion and a lower portion, and includes backing having a top edge and a bottom edge, an upper flange extending from the top edge, and a lower flange extending from the bottom edge. The upper and lower flanges defining a channel therebetween for receiving the tag therein. The backing is shaped to cooperate with the tag such that the one of the portions of the conductive coil is located adjacent one of the portions of the conductive loop when the tag is received in the rail.

The present invention is also a tag that is shaped to be received in a rail having a conductor loop. The tag has a conductive coil, and includes a projection for engaging the rail so that the conductive coil is located adjacent the conductive loop. In one embodiment, the invention is a tag for being received in a rail and for displaying information about an associated product, the rail receiving a conductive loop having an upper portion and a lower portion. The tag comprises a body having a front surface for displaying the information and a conductive coil. The conductive coil has an upper portion and a lower portion, wherein the body cooperates with the rail such that when the tag is received in the rail the one of the portions of the conductive coil is located adjacent one of the portions of the conductive loop.

The present invention is also a tag that is shaped to be received in a rail, wherein the tag includes a boss for preventing the tag from substantially sliding within the rail. In one embodiment, the present invention is a tag for being received in a rail and for displaying information about an associated product, the rail including an upper flange and a lower flange defining a channel for receiving the tag therein, the rail including at least one protrusion extending into the channel. The tag comprises a body having a front surface for displaying the information, the body including a recess for receiving the protrusion therein when the tag is received in the channel such that the protrusion cooperates with the tag to block significant lateral movement of the tag within the channel.

The present invention is also a tag for being received in a rail, wherein tag includes a tab to retain the tag in the rail. In one embodiment, the present invention is a tag for being received in a rail and for displaying information about an associated product, the rail including an upper flange and a lower flange defining a channel for receiving the tag therein. The tag comprises a body having an edge surface, a front surface for displaying the information, and a tab extending from the edge surface, the tab being shaped to be received in the upper flange or the lower flange when the body is received in the channel to thereby retain the tag in the rail.

The present invention is also a tool for uncoupling a tag from a rail. In one embodiment, the present invention is a tool for uncoupling tag from a rail, the rail having an upper flange and a lower flange defining a channel therebetween, the tag having a tab received in either the upper flange or the lower flange when the tag is in the channel. The tool comprises a generally flat finger having a tapered edge, the finger being shaped to be received between the flange receiving the tab and the tab to urge the flange and tab apart, and wherein when the tool is moved down the length of the tab the finger urges the entire length of the tab apart from the flange to thereby uncouple the tag from the rail.

Other objects and advantages of the present invention will become apparent from the following description, the accompanying drawings and the appended claims.

DETAILED DESCRIPTION

Figure 1:
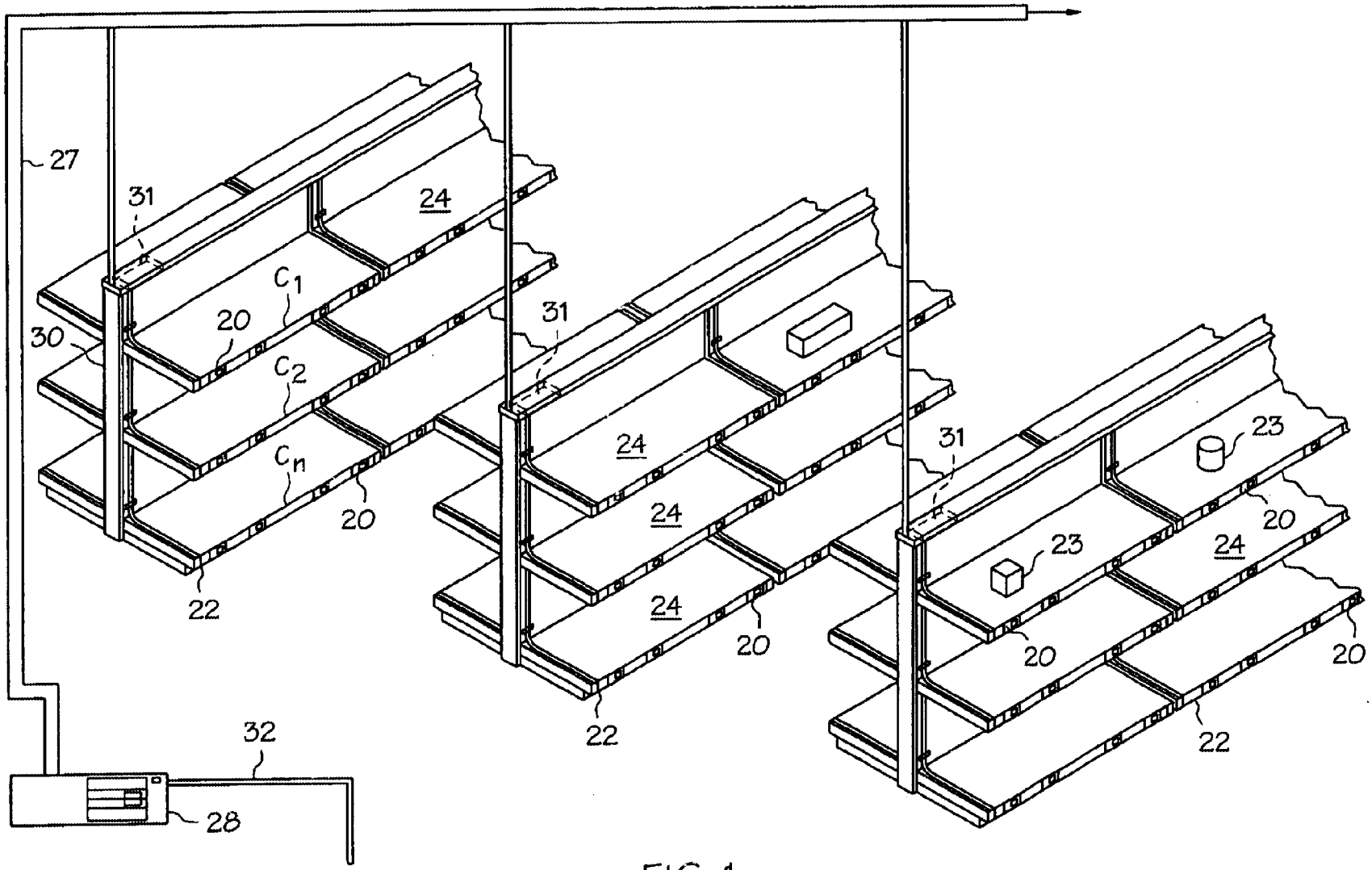
FIG. 1 is a perspective view of part of a retail store equipped with a product information display system incorporating the present invention.

FIG. 1 illustrates an example of an electronic product information display system for use with the present invention. The system includes a plurality of display shelves 24 each having a front edge 22. The display shelves 24 receive products 23 thereon for display and purchase by consumers. Each shelf edge 22 receives one or more display tags 20 therein. Information associated with the products 23 on the shelves 24, such as prices, price per unit weight, product descriptions and other information can be electronically displayed on the tags 20. A plurality of tags may be spaced along each rail 24, and each tag 20 is located adjacent a product 23 associated with the information displayed on the tag 20.

Figure 2:
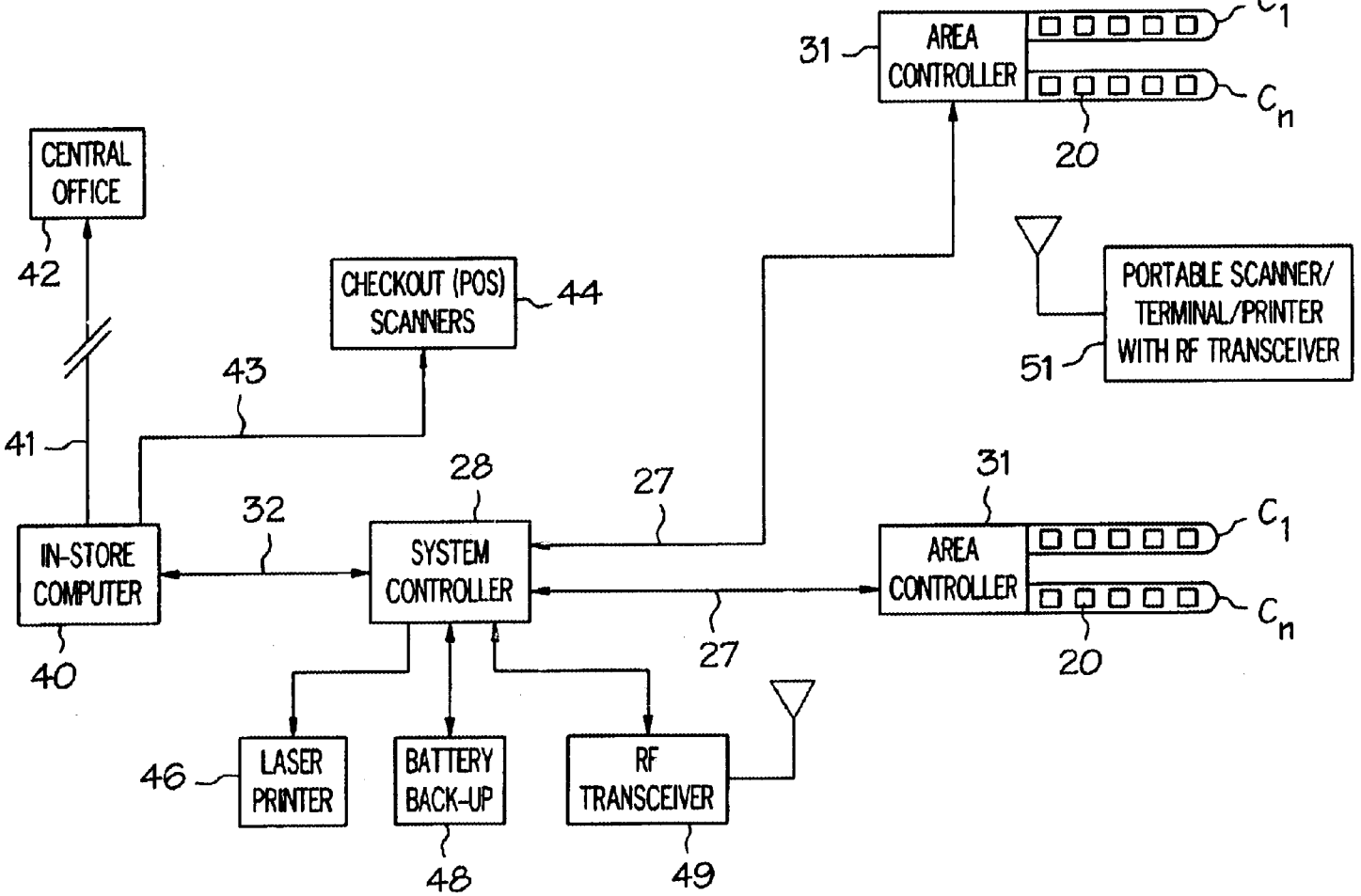
FIG. 2 is a block diagram of a typical product information display system.

As shown in FIG. 2, the electronic tag display system preferably includes an in store computer 40 that includes a database of information received from the central office 42 (or from a scanner controller). The computer database includes information related to the displayed merchandise 23, and in one embodiment the database links each displayed product 23 with a physical location address, an alphanumeric description, a UPC, a price, a unit cost and general inventory information. In order to display the information at a tag 20, the central computer 40 supplies the information to be displayed to a system controller (TSC) 28. After receiving the product data, the system controller 28 identifies the desired display information and the associated display tag location, and converts this information into a data stream for transmission to the appropriate area controller 31 via cable 27. Each area controller 31 is coupled to multiple conductors $C_1$, $C_2$ . . . $C_n$. Each conductor $C_1$–$C_n$ is preferably a wire, and forms a loop extending along the shelf edge 22. Each loop extending along the shelf edge 22 may include one or more tags 20 therein, and the conductors $C_1$–$C_n$ transmit power and information from an area controller 31 to the display tags 20. Data sent to the display tag 20 via the conductor or conductive loop C is then received and processed by the appropriate display tag 20, which posts the processed information in a visually recognizable form.

The database in the computer 40 may be accessed through the check-out scanners 44 via access line 43. In this manner, the price charged to the customer at the check-out scanner 44 is coordinated with the price displayed on the display tag 20 for a given product. Changes in the database of the computer 40 are generally initiated by updates received from the central office 42, but changes in the computer database can also be directly entered at the in store computer 40.

A printer 46 is coupled to the system controller 28. The printer 46 may output hard copies of the desired information (i.e. price) on regular or transparent paper for insertion into a shelf rail 22. The printer 46 can also be used to generate store or system reports that can be used to audit pricing strategy down to the individual shelves 24 and tags 20. A battery back up unit 48 may be coupled to the system controller 28 to provide power and maintain system integrity during periods of power interruption.

A RF transmitter/received (transceiver) 49 may also be connected to the system controller 28. The RF transceiver 49 may be coupled to a portable device 51 that may have a scanner, printer and an associated transceiver for communicating with the RF transceiver 49. The transceivers in the RF transceiver 49 and portable device 51 may be any desired transceiver for communicating data, such as a Telxon PTC 960. The RF link between the RF transceiver 49 and portable device 51 enables a worker to be remotely linked to the system controller 28 to facilitate installation of tags 20, as well as for maintenance or updating services.

For example, the portable device 51 may be used to set or update the price displayed on a tag 20 for an associated product 23. In order to do this, the employee may first scan the UPC code on the product 23. The scanned signal is sent to the system controller 28, which identifies the product 23 and accesses the information associated with the product. The employee then identifies the tag 20 which he or she wishes the information for the scanned product to be displayed upon. The employee activates a switch on this desired tag, which sends a signal to the system controller 28 such that the system controller 28 can identify which tag 20 has been selected. The system controller then sends the appropriate information to the tag 20 via the cable 27 and conductors C such the appropriate information (i.e. price) is displayed on the desired tag 20.

Figure 3:
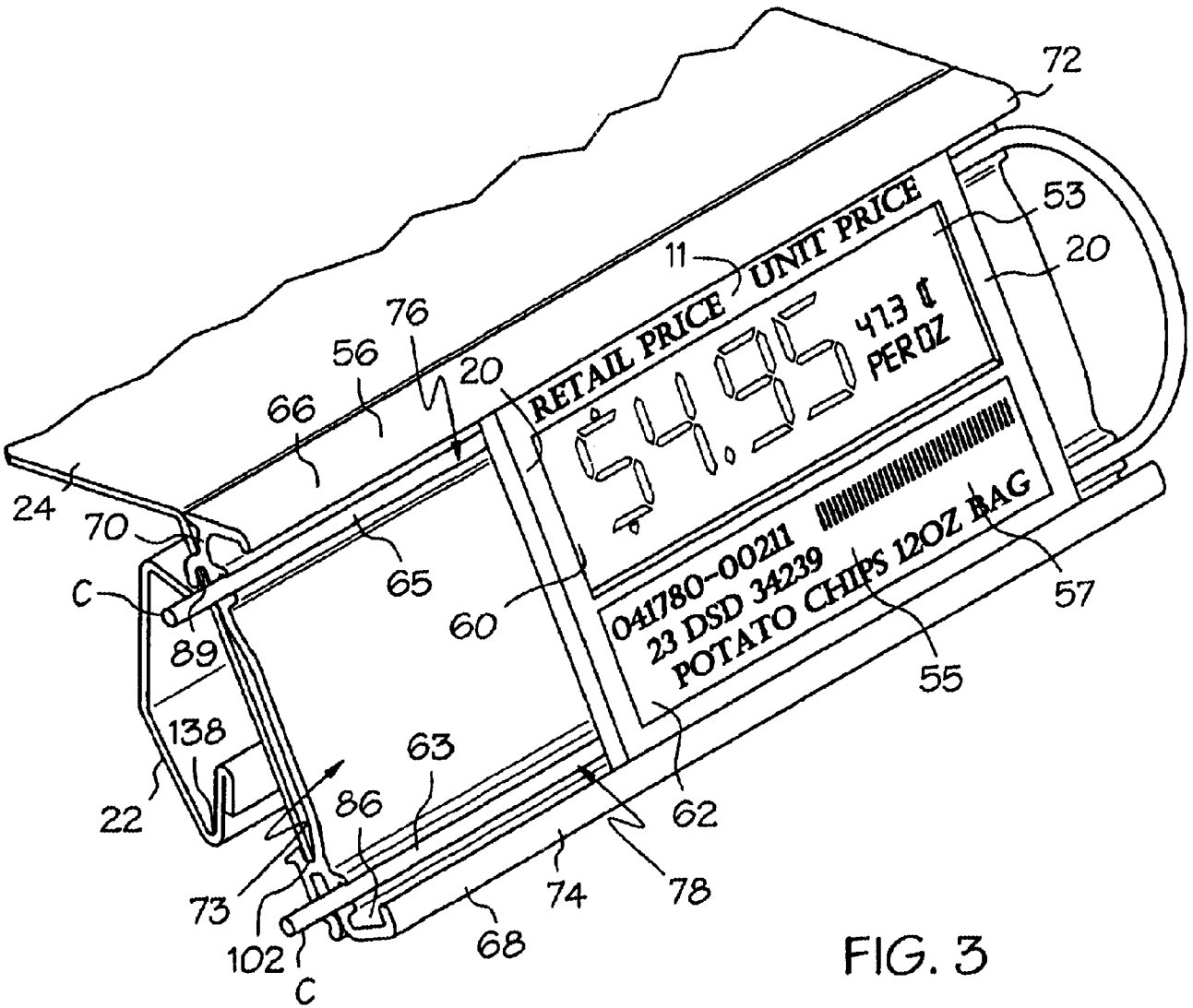
FIG. 3 is a perspective view of a shelf edge, an auxiliary rail, and a tag mounted in the auxiliary rail.
Figure 4:
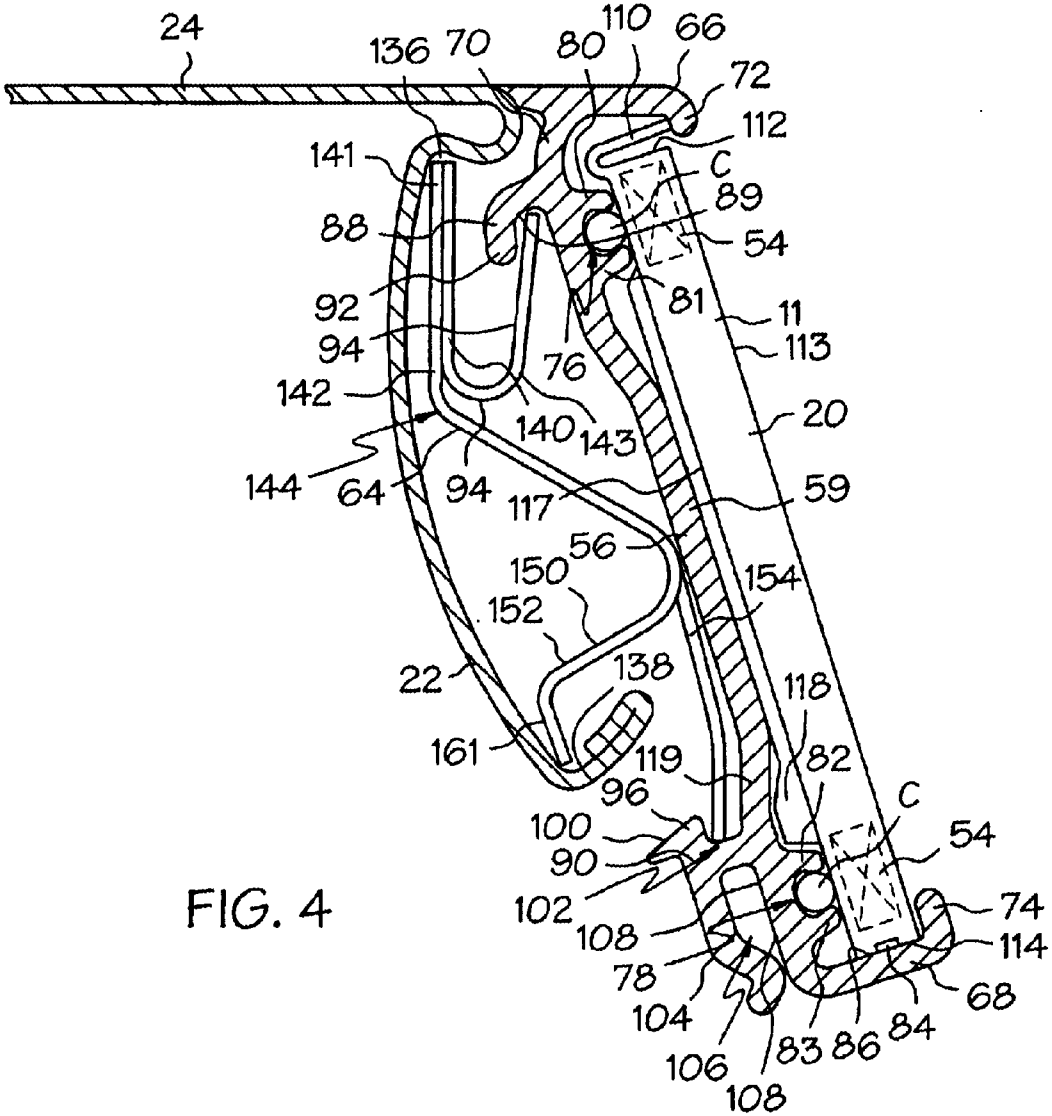
FIG. 4 is a side cross sectional view of the shelf edge, auxiliary rail, and tag of FIG. 3, shown with a bracket coupling the auxiliary rail to the shelf edge.

Data sent to the display tag 20 via the conductor C is received by the display tag 20 through electromagnetic inductive coupling. As best shown in FIGS. 3 and 4, the display tag 20 includes an internal pick up coil or conductive coil 54 (FIG. 4) extending about the periphery of the tag 20. The pick up coil 54 is positioned in close proximity to the conductor C such that changing electromagnetic field around the pick up coil 54 (which is caused by oscillating the current in the conductor C) induces an associated current in the pick up coil 54. This induced current provides the display tag 20 with operating power, display data and other control signals. The inductive transmission of both power and information to the display tags 20, in addition to other aspects of the above electronic product information display system, is described in detail in U.S. Pat. No. 5,537,126, the disclosure of which is hereby incorporated by reference.

Figure 5:
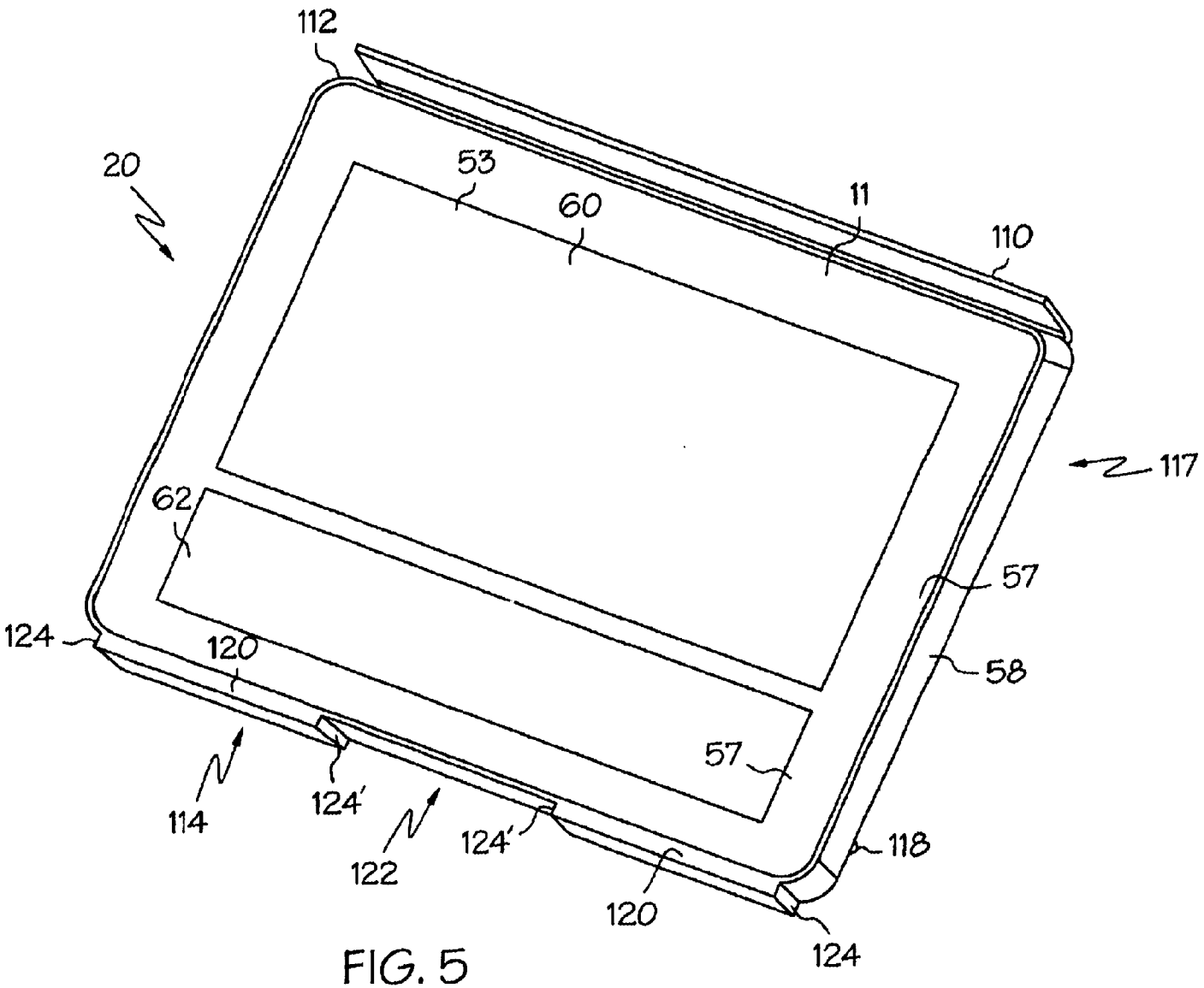
FIG. 5 is a front perspective view of a display tag.

As shown in FIGS. 3–5, each display tag 20 includes a body 11 and is preferably generally rectangular in shape having a length, width and thickness sufficient to fit within an associated auxiliary rail 56. A thin overlay 57 (FIG. 3, FIG. 5) is affixed to the front surface of the display tag 20. The overlay 57 is preferably a generally flexible sheet preferably adhesively applied to the display tag 20, and includes a generally transparent portion 53 and a generally opaque portion 55. A display 60, such as a LCD display, is visible through a clear portion 53 of protective overlay 57. In one embodiment, display 60 has a length and width of about 2.5 inches and 0.9 inches, respectively, equating to an area of about 2.25 square inches. The ratio of display 60 area to display tag 20 area in this embodiment is approximately 52%, which provides a large surface for displaying information. Of course, tags having nearly any dimension and having various sizes of displays and other types of displays may be used without departing from the scope of the present invention. These dimensions may vary as needed or desired by the user.

The generally opaque portion 55 of the protective overlay 57 conceals the majority of internal components and structure of the display tag 20 to enhance the visual appearance of the display tag 20. The opaque portion of protective overlay 57 may be imprinted with textual and graphic information, or labels 62 may be applied thereto (FIG. 3) to supplement the information provided on display 60.

Referring to FIG. 3, a display tag 20 is shown received in an auxiliary rail 56. The rail 56 is coupled to a shelf edge 22 of a shelf 24 by a universal shelf edge adapter bracket (not shown in FIG. 3) which will be discussed in greater detail below. The auxiliary rail 56 is made from any suitable material, preferably extruded PVC, and is sufficiently flexible and pliable to facilitate bending and flexing, yet is sufficiently resilient to return substantially to its original shape after the bending or twisting force is removed. As best illustrated in FIG. 4, the auxiliary rail 56 includes backing 59, and an upper tag retaining flange 66 and a lower tag retaining flange 68 extending forwardly from the backing 59. The upper flange 66 and lower flange 68 define a channel 73 (FIG. 3) therebetween for receiving the tag 20 therein. The auxiliary rail 56 preferably includes a flexible upper arm portion 70 adjacent the upper flange 66 which facilitates upwardly flexing of the upper flange 66 to receive the tag 20 therein (FIG. 4). The upper flange 66 includes a downwardly extending lip 72 that extends downward from the forward edge of the flange 66. The lip 72 helps to retain the display tag 20 within the auxiliary rail 56. Similarly, the lower tag retaining flange 68 includes an upwardly extending lip 74 that helps to retain the display tag 20 within the auxiliary rail 56. Preferably, the lower tag retaining flange 68 is flexible but somewhat more rigid than the upper tag retaining flange 66. The upper surface of the lower tag retaining flange 68 and forms a tag support surface 86 upon which the tags 20 may rest. The ends of the conductor C extending from the auxiliary rail are received in an E-core coupler as described in U.S. patent application Ser. No. 09/167,706.

Figure 8:
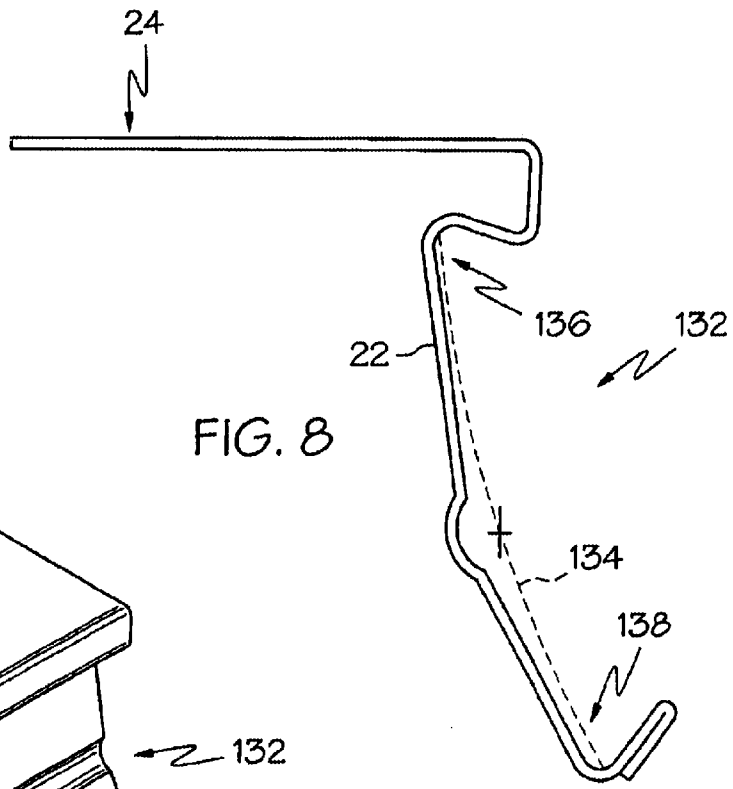
FIG. 8 is a side cross sectional view of a shelf and shelf edge.
Figure 9:
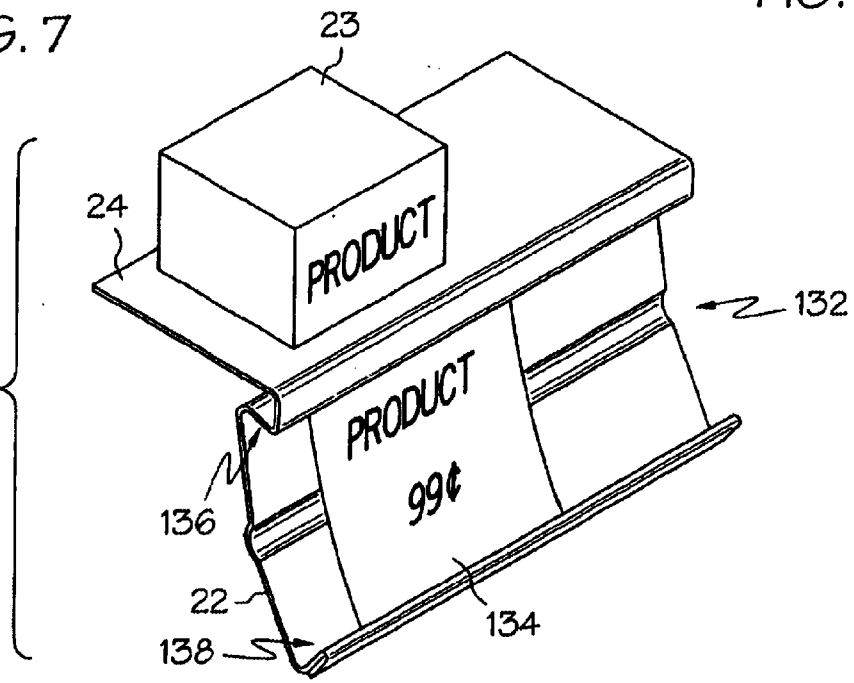
FIG. 9 is a perspective front view of the shelf and shelf edge of FIG. 8, shown with a product and a printed display tag.
Figure 10B:
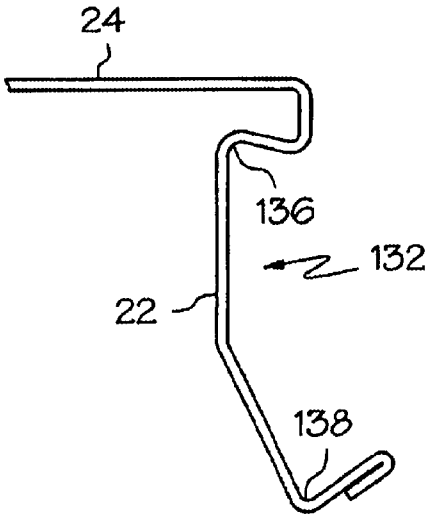
FIG. 10B is a side, cross sectional view of another shelf and shelf edge for use with the present invention.
Figure 10C:
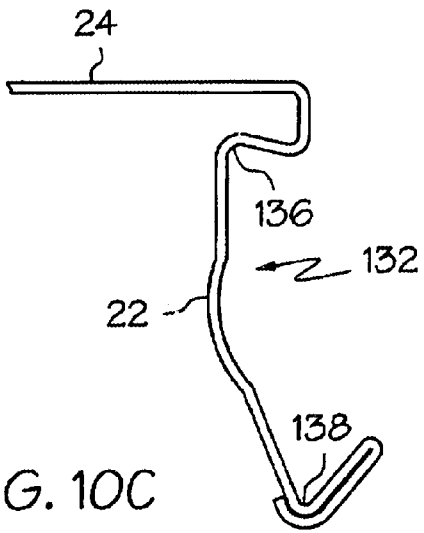
FIG. 10C is a side, cross sectional view of yet another shelf and shelf edge for use with the present invention.
Figure 10A:
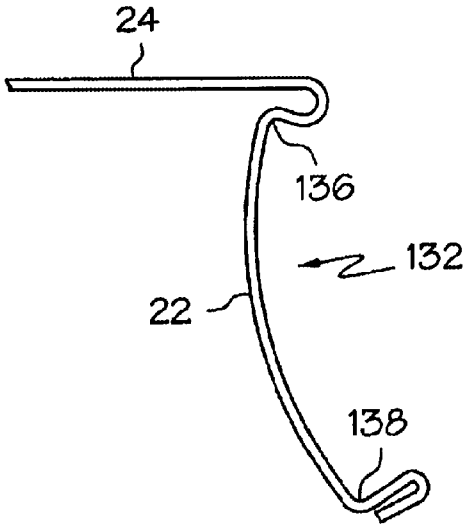
FIG. 10A is a side, cross sectional view of a shelf and shelf edge for use with the present invention.

An adapter bracket can be used to attach the auxiliary rail 56 to the shelf edge 22 of the shelf 24. As shown in FIGS. 8 and 9, conventional store shelves 24 include a shelf edge 22 including a concave, generally "C" shaped tag slot 132 for receiving a paper or plastic price tag 134 therein. The tag slot 132 includes an upper groove 136 and a lower groove 138 for receiving the upper and lower edges of the price tag 134, respectively. There are several different commercial designs existing for the shelf edge 22 of the shelving assemblies, three of which are shown in FIGS. 10A–10C. FIG. 10A illustrates a shelf edge 22 commercially manufactured by Lozier of Omaha, Nebr. FIG. 10B illustrates a shelf edge 22 commercially manufactured by Madix Store Fixtures of Terrell, Tex., and FIG. 10C illustrates a shelf edge 22 commercially manufactured by The Kent Corporation of Birmingham, Ala. The shelf edge adapter brackets of the present invention are designed, to the extent possible, to be attached to each of the shelf edges shown in FIGS. 10A–10C, as well as to several other shelf edge designs not specifically discussed herein. Once the adapter bracket is mounted to the shelf edge 22, it may receive an auxiliary rail 56 thereon. Alternately, the adapter bracket may first be mounted to the auxiliary rail 56, and the rail 56 and bracket may then be attached to the shelf edge 22.

Figure 11:
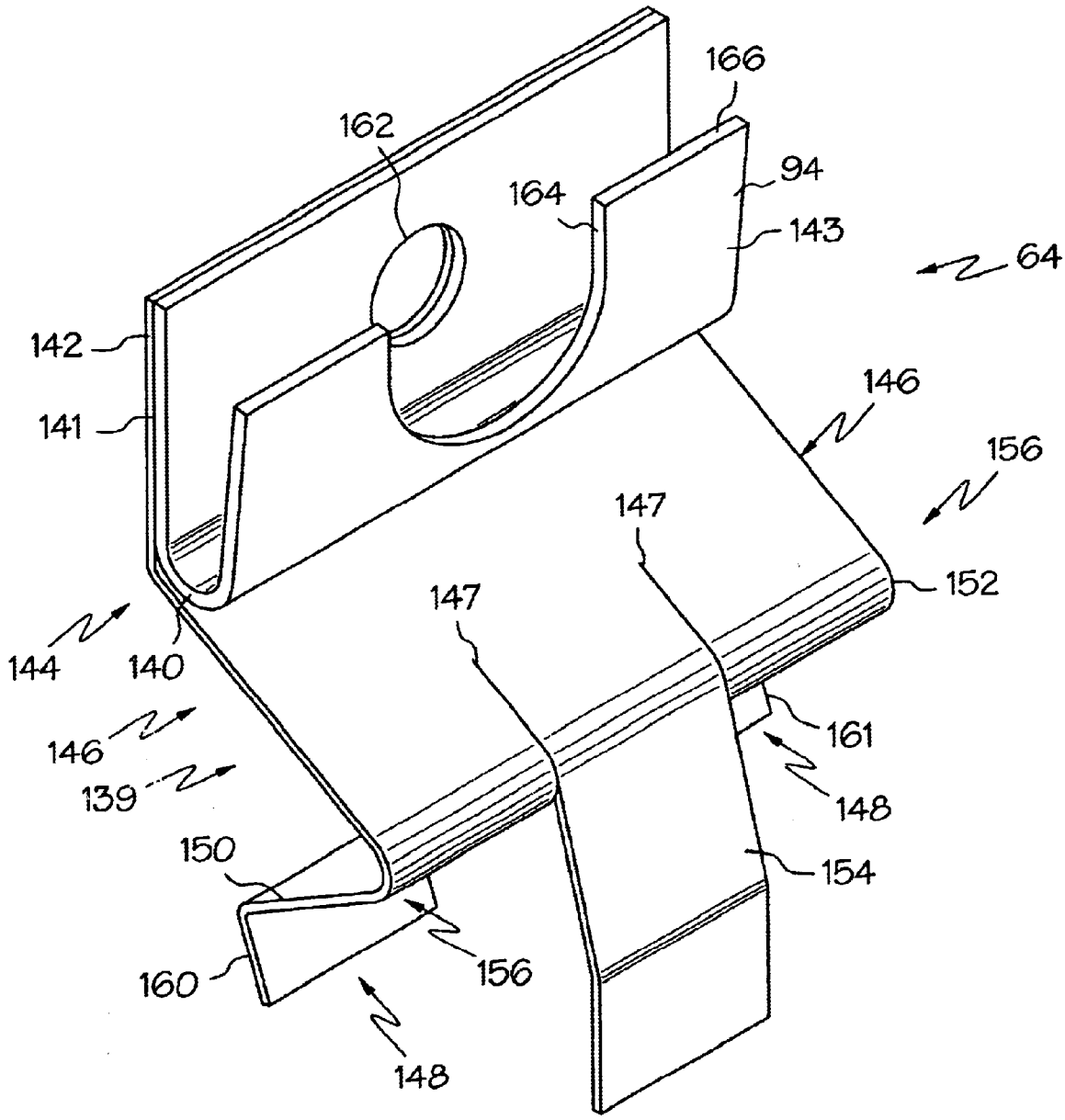
FIG. 11 is a front perspective view of one embodiment of the shelf edge adapter bracket of the present invention.

As shown in FIGS. 4 and 11, one embodiment of the shelf edge adapter bracket 64 includes an central body 139 having a front portion 140 and a rear portion 142. The front 140 and rear 142 portions may be stamped from stainless spring stock, although a variety of other materials may be used, and other methods of forming the front and rear portions may be used. Nevertheless, it is preferred that the bracket 64 be formed from a resilient, sheet material. The front 140 and rear 142 portions may be welded together or joined using other conventional means, such as rivets, clips, staples, bonding materials, and the like. Alternately, the front 140 and rear portions 142 may be unitary. The front portion 140 is generally "U" shaped in side view, and has upper tang 94. The rear portion 142 extends forwardly from a point 144 (FIG. 11) between the top edge and the midpoint of the rear portion 142. The segment 146 of the rear portion 142 extending below the point 144 includes two longitudinally extending cuts 147. The cuts 147 define a pair of lower flanges or legs 150, 152 and a lower tang 154. The flanges 150, 152 extend rearwardly from a point 156 between the midpoint and the lower edge 148 of the rear portion 142. The flanges 150, 152 then extend forwardly from a point near the lower edge 148 to define a pair of feet 160, 161.

The lower tang 154 extends generally forwardly from point 156. The upper end of the rear portion 142 forms an upwardly extending flange 141. The upper flange 141 extends generally in the same direction as the upper tang 94, and the lower flanges 150, 152 extend generally in the same direction as the lower tang 154. The bracket 64 may be formed by forming the body 139 generally in the illustrated shape, and then forming the cuts 147 in the body 139. The tab defined by the cuts 147 may then be bent generally forwardly with respect to the body 139 to form the lower tang 154 in the illustrated shape and location.

The front and rear portions 140, 142 preferably include a hole 162 therethrough for receiving a fastener that may be used to secure the bracket 64 to the shelf edge 22. The fastener may be used as an extra method of fitting the bracket 64 to the shelf edge, or may be used if the bracket 64 fits loosely within the shelf edge 22 or if the shelf edge 22 is damaged or mis-shaped. The upper tang 94 may include an arcuate cutout or recessed area 164 extending into a top surface 166 of the tang which provides access for a tool, such as a screwdriver, to the fastener extending through hole 162.

In order to mount the bracket 64 into a shelf edge 22, the upper flange 141 is fitted into the upper groove 136 (FIG. 4) of the shelf edge 22, and the lower flanges 150, 152 are fit into the lower groove 138 of the shelf edge 22. The overall vertical height of the rear portion 142 (i.e. the distance between the upper flange 141 and lower flanges 150, 152) is preferably slightly longer than the distance between the upper and lower grooves 136, 138 of the shelf edge 22. In this manner the lower flanges 150, 152 and/or upper flange 141 must be slightly compressed toward each other to enable the bracket 64 to be inserted within the shelf edge 22. Accordingly, once positioned inside the shelf edge 22, the spring action of the flanges 150, 152 141 help to secure the bracket 64 within the tag slot 132. If desired, a fastener, such as a sheet metal screw, may be passed through the hole 162 and through a corresponding hole in the shelf edge to further secure the bracket 64 to the shelf edge 22.

Once the bracket 64 is secured to the shelf edge 22, an auxiliary rail 56 may be attached to the bracket. As shown in FIG. 4, the auxiliary rail 56 includes an upper hook 88 defining an upper slot 89 therein. The auxiliary rail 56 also includes a corresponding lower hook 90 defining a lower slot 102 therein. The upper tang 94 of the bracket 64 is received in the upper slot 89 of the auxiliary rail 56. The upper hook 88 of the auxiliary rail 56 preferably includes a downwardly extending projection 92 which helps to maintain the upper tang 94 of the bracket 64 in the upper slot 89. Similarly, the lower tang 154 of the bracket 64 is received in the lower slot 102 of the auxiliary rail 56. The lower hook 90 of the auxiliary rail 56 includes an upwardly extending projection 96 which helps to maintain the lower tang 154 of the bracket 64 in the lower slot 102. The distance between the ends of the tangs 94, 154, may also be greater than the distance between the upper slot 89 and lower slot 102. In this manner, the tangs 94, 154 are compressed toward each other to be received in the slots 89, 102, and the spring force in the tangs 94, 154, helps to retain them in the slots 89, 102.

The upwardly extending projection 96 preferably includes a tapered edge 100 that facilitates snapping the lower tang 154 into the lower slot 102. In order to mount the auxiliary rail 56 to the bracket 64, the upper tang 94 of the adapter bracket 64 is first slid into the upper slot 89 of the auxiliary rail. Next, lower tang 154 is pressed against the tapered leading edge 100 of the upper extending projection 96. The lower tang 154 and the lower portion of the auxiliary rail 56 are then squeezed together. Upon the application of sufficient pressure, the lower tang 154 flexes upwardly, travels past the tapered leading edge 100, and snaps into the lower slot 102. Once the auxiliary rail 56 is thereby mounted to the shelf edge 22 via the bracket 64, one or more tags 20 may be mounted in the auxiliary rail 56, as will be described in greater detail below.

Figure 23:
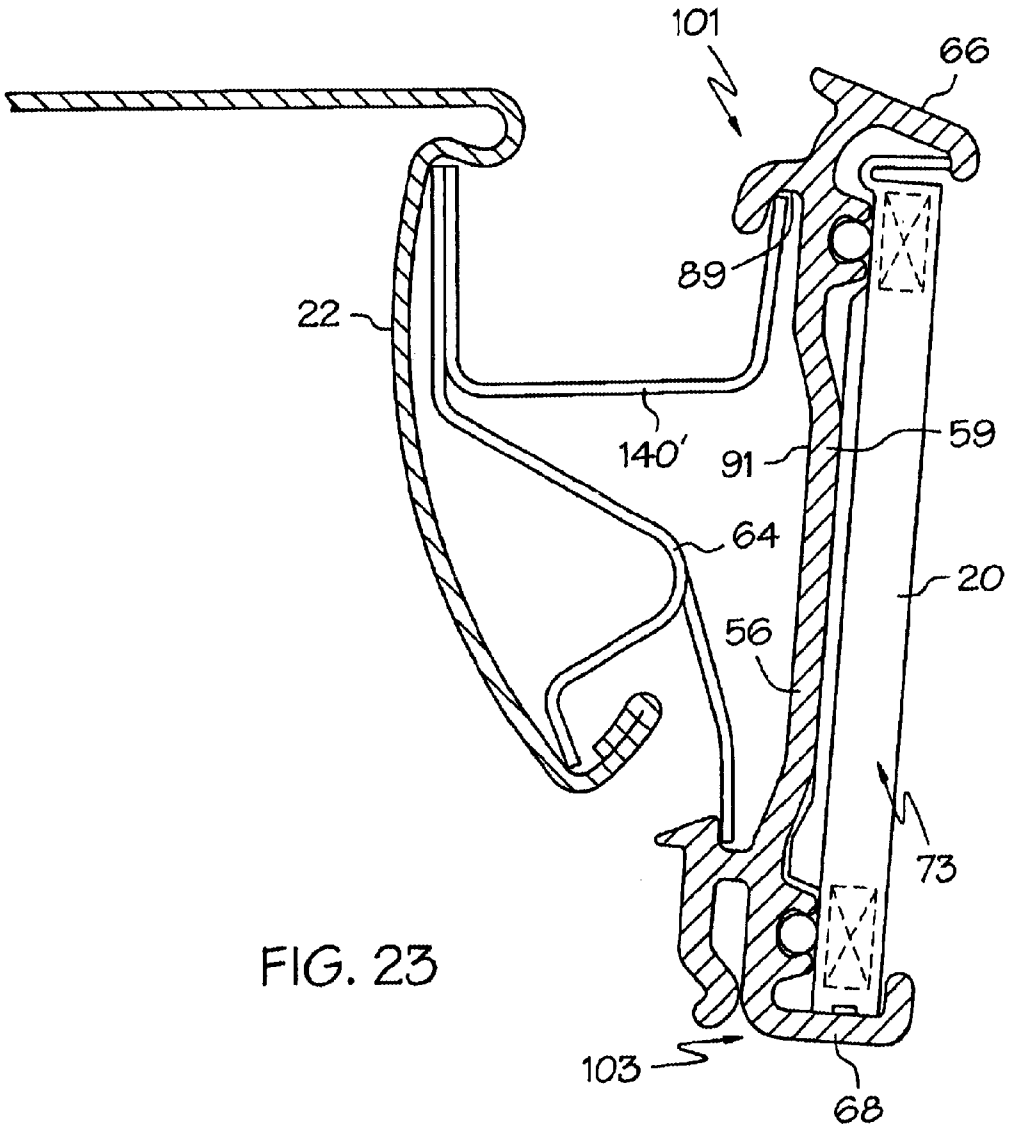
FIG. 23 is a side, cross sectional view of an alternate embodiment of the adapter clip of FIG. 11, shown mounted to a shelf edge and an auxiliary rail.
Figure 24:
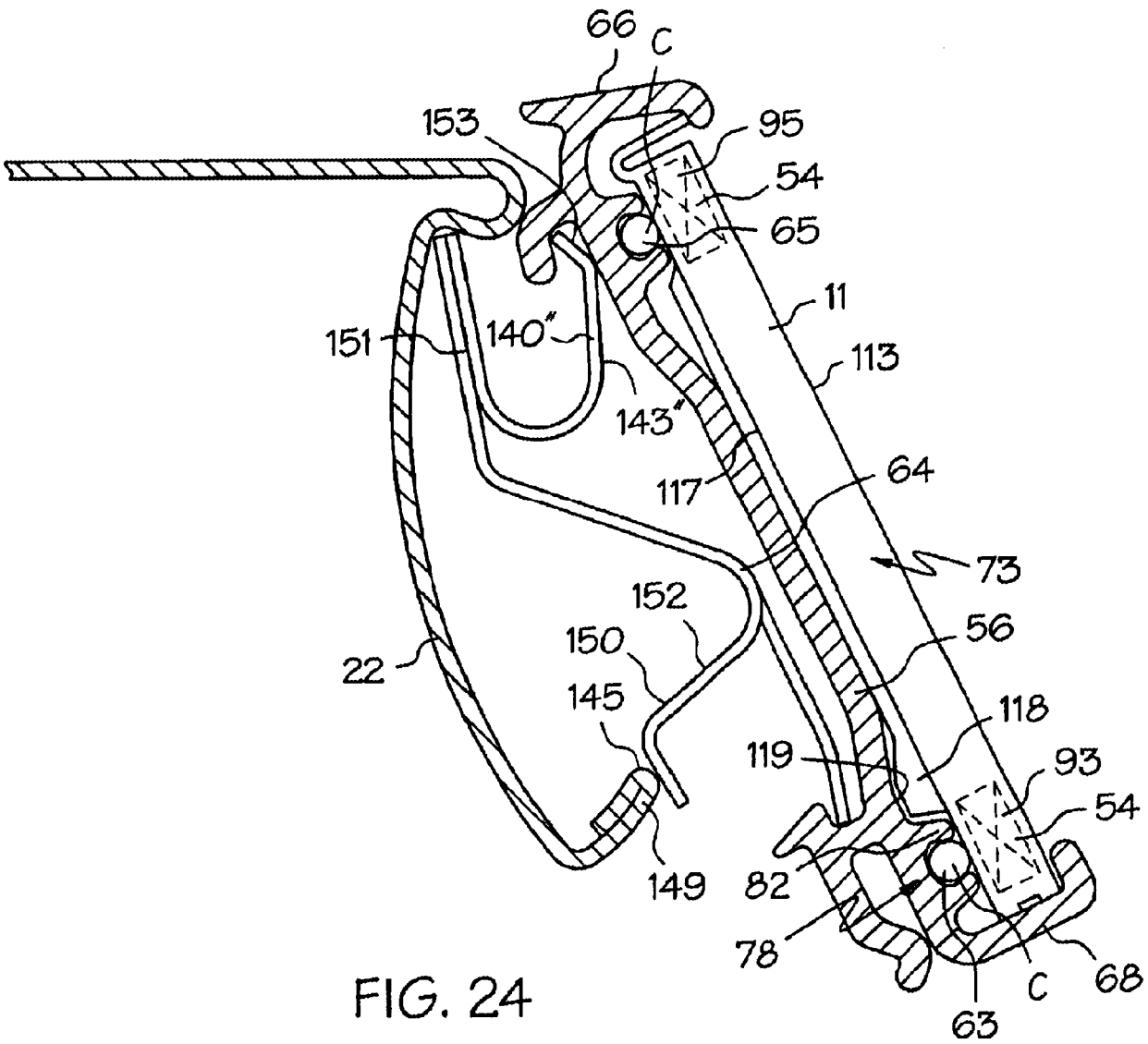
FIG. 24 is a side, cross sectional view of another alternate embodiment of the adapter clip of FIG. 11, shown mounted to a shelf edge and an auxiliary rail.

It should be noted that the upper portion 140 may be formed with a variety of shapes to change the angle of the auxiliary rail 56 mounted thereon. For example, when the bracket 64 is mounted to a relatively high shelf, such as an upper shelf, it may be desired to decrease the viewing angle of the auxiliary rail 56 and tag 20 so that the tag 20 is more easily viewed by consumers. In this case, the upper portion 140' as shown in FIG. 23 may be used in place of the upper portion 140. The upper portion 140' extends away from the shelf edge 22 further than the upper portion 140 shown in FIG. 11, and thereby decreases the angle of the rail 56. Similarly, when an auxiliary rail 56 is mounted on a bottom shelf edge or a to relatively low shelf edge, it may be desired to increase the upward angle of the auxiliary rail 56 to increase its visibility. In order to raise the angle of the rail 56, as shown in FIG. 24, the lower flanges 150, 152 may be seated on the outside surface 145 of the lower lip 149 of the shelf edge 22. This helps to enhance the viewing position of the auxiliary rail 56, and therefore the tag 20 contained therein. In this case, the bracket must have an attachment portion 151 for receiving a fastener to attach the bracket to the shelf edge 22. In order to further enhance the viewing position of the auxiliary rail 56 for lower shelves, the upper portion 140" shown in FIG. 24 may be used in place of the upper portion 140 of FIG. 11. The upper portion 140" includes an angled portion 153 on the front face 143" that aids in further decreasing the angle of the auxiliary rail 56 and tag 20. FIG. 23 illustrates that the upper slot 89 is located on the back side of the rail 56 adjacent a top edge of the rail 56. The lower slot 102 is located on the back side 91 of the rail 56 adjacent a bottom edge of the rail 56. The rail 56 includes a backing 59 that has an upper edge 101 and a lower edge 103. The upper tag retaining flange 66 extends from the upper edge 101 of the backing 59, and the lower tag retaining flange 68 extends from the lower edge 103 of the backing 59. The flanges 66, 68 define a channel 73 therebetween for receiving a tag 20 therein.

Following from the above description of the shelf edge adapter bracket 64, it will be apparent to those of ordinary skill in the art that the shelf edge adapter bracket 64 facilitates relatively simple installation of the auxiliary rails 56, and in turn the display tags 20, to most of the conventional shelving assemblies being used in retail establishments, including those with damaged and misshaped shelf edges. It should be noted that a plurality of the shelf edge adapter brackets 64 can be distributed along each of the shelf edges 22, or a single, continuous bracket may be located along the length of the shelf edge.

Figure 6B:
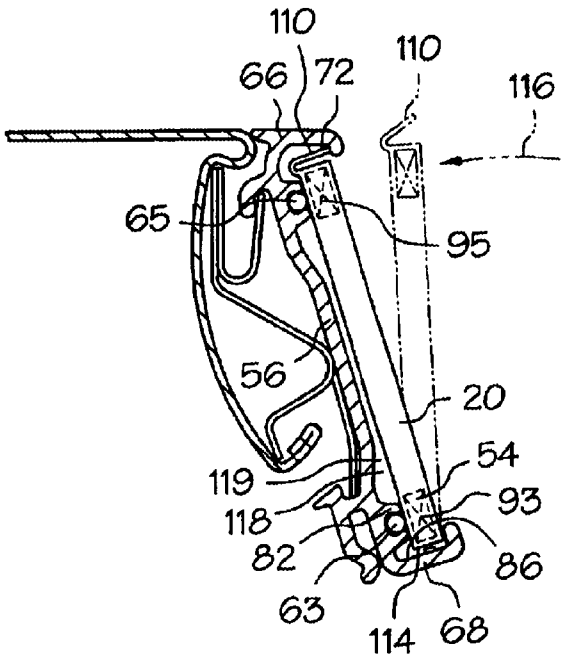
FIG. 6B is a cross sectional side view of the shelf edge, auxiliary rail and tag of FIG. 4 showing the steps to mount the tag in the auxiliary rail.
Figure 6A:
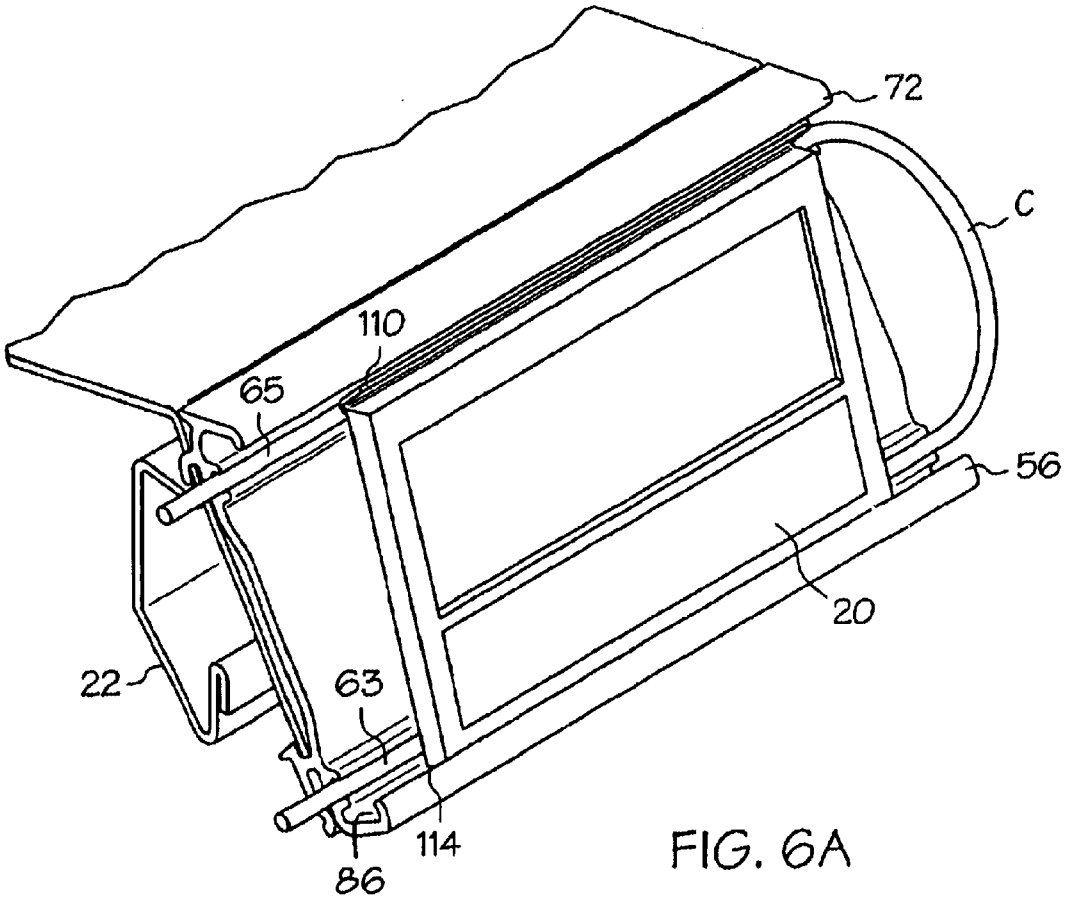
FIG. 6A is a perspective front view of a tag, auxiliary rail and shelf edge, with the tag uncoupled from the auxiliary rail.

Once the auxiliary rail 56 is mounted to the shelf edge 22, one or more display tags 20 may be mounted in the auxiliary rail 56 for displaying information about the products 23. As shown in FIGS. 4–5, each display tag 20 preferably includes a flexible tab 110 extending forwardly and upwardly from the rear edge of the top surface 112 of the display tag. As best shown in FIGS. 5, 6A and 6B, in order to mount the display tag 20 to an auxiliary rail 56, the lower surface 114 of the display tag 20 is seated on the tag support surface 86 of the auxiliary rail 56. The display tag 20 is then rotated substantially about the lower surface 114 as indicated by arrow 116 (FIG. 6B). After sufficient rotation, that the flexible tab 110 contacts the lip 72 of the upper tag retaining flange 66. Upon the application of sufficient force in the direction of the arrow 116 the flexible tab 110 is flexed downwardly and/or the flange 66 flexes upwardly, thereby permitting the display tag 20 to be completely received within the auxiliary rail 56 between the upper tag retaining flange 66 and the lower tag retaining flange 68. Once the flexible tab 110 slides past the lip 72 of the upper tag retaining flange 66, the flexible tab 110 springs upwardly, thereby locking the display tag 20 into the auxiliary rail 56. The tag 20 is then locked into the rail 56 such that the display tag 20 cannot be removed from the auxiliary rail 56 without the use of a specialized tool as will be described below. Of course, the flexible tab 110 may alternately extend from the lower surface 114 of the tag 20, and thereby be received in the lower tag receiving flange 68. Thus the flexible tab 110 may extend from either edge surface 112, 114.

Figure 7:
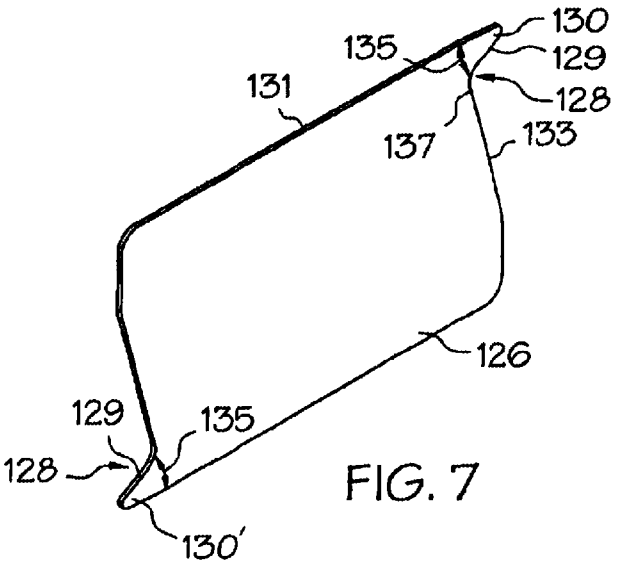
FIG. 7 is a front perspective view of a tag removal tool.

To remove the display tag 20 from the auxiliary rail 56, a removal tool 126 as shown in FIG. 7 is used. The removal tool 126 is a generally flat card, and has a cut out 128 formed on an edge 133 of the tool 126. The cut out 128 defines a finger 130 having a tapered edge 129. In a preferred embodiment, the tapered edge 129 forms an angle of about 30 degrees with the top edge 131 of the tool, although other angles may be used, preferably between about 15–60 degrees. The base 135 of the finger 130 is preferably about the same width as the tab 110. The cut out 128 preferably forms an angle of about 15 degrees with a side edge 133 of the tool 126, although a wide range of angles may be implemented. The tool 126 may also include a second finger 130', preferably on an opposed corner so that the tool 126 may be used in a variety of orientations. The tip of the finger 130 is preferably rounded to keep it from catching on the rail 56 and tag 20. The junction 137 between the finger 129 and side edge 133 is preferably rounded to form a smooth transition. In a preferred embodiment, the tag is about 3⅜ inches long and about 2⅛ inches wide. The tip of the finger 129 is preferably formed at about a 0.045 inch radius, and the radius of the junction 137 is preferably about 0.125 inches. The length of the tapered edge 129 is preferably about 0.43 inches (including the length of the radius of the tip and the radius of the junction 137). The base 135 of the finger 129 is preferably about 0.275 inches long.

Figure 25:
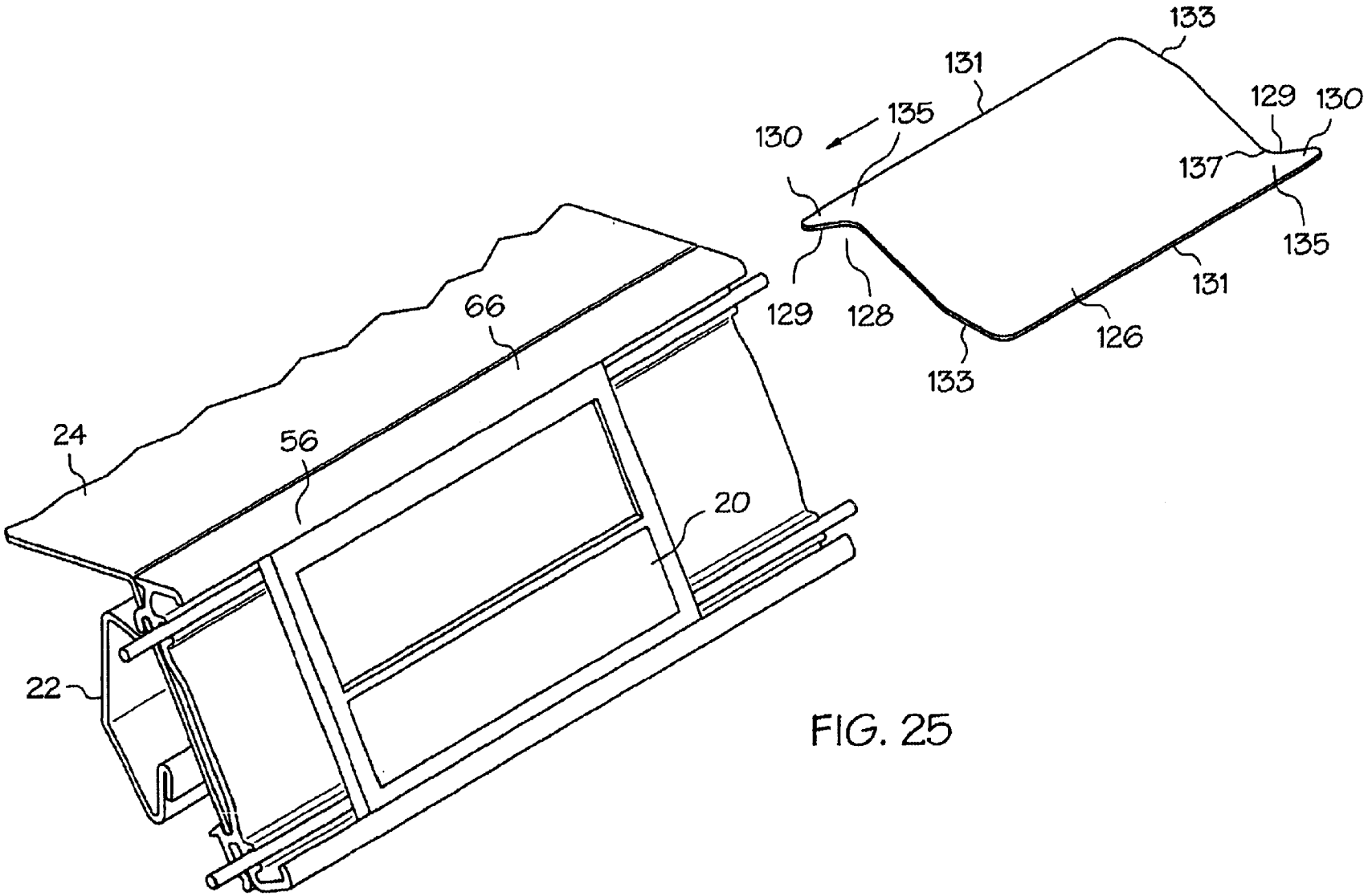
FIGS. 25–28 are front perspective views of a shelf edge, auxiliary rail and tag, illustrating the use of a shelf removal tool to uncouple the tag from the auxiliary rail.
Figure 26:
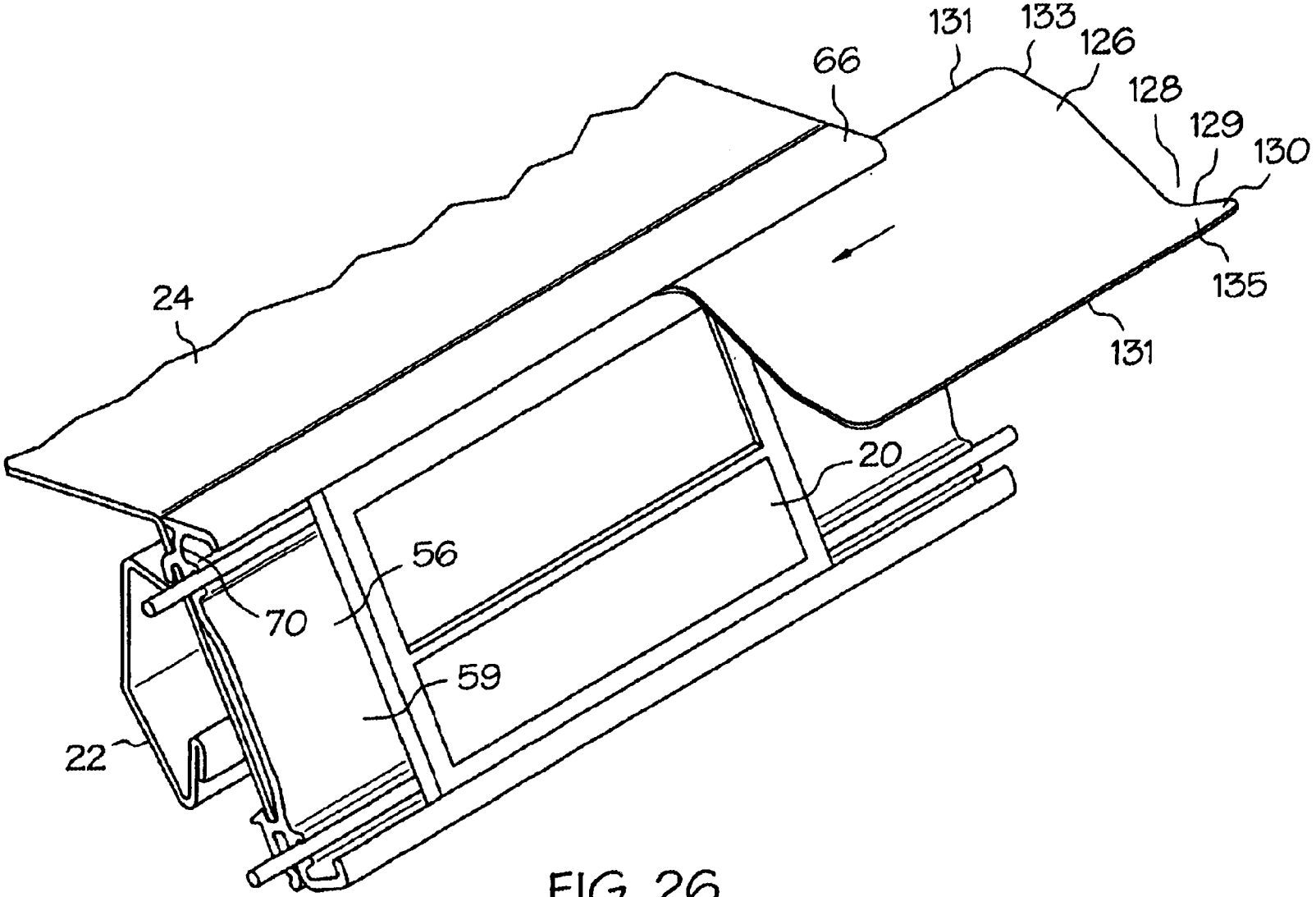
Figure 27:
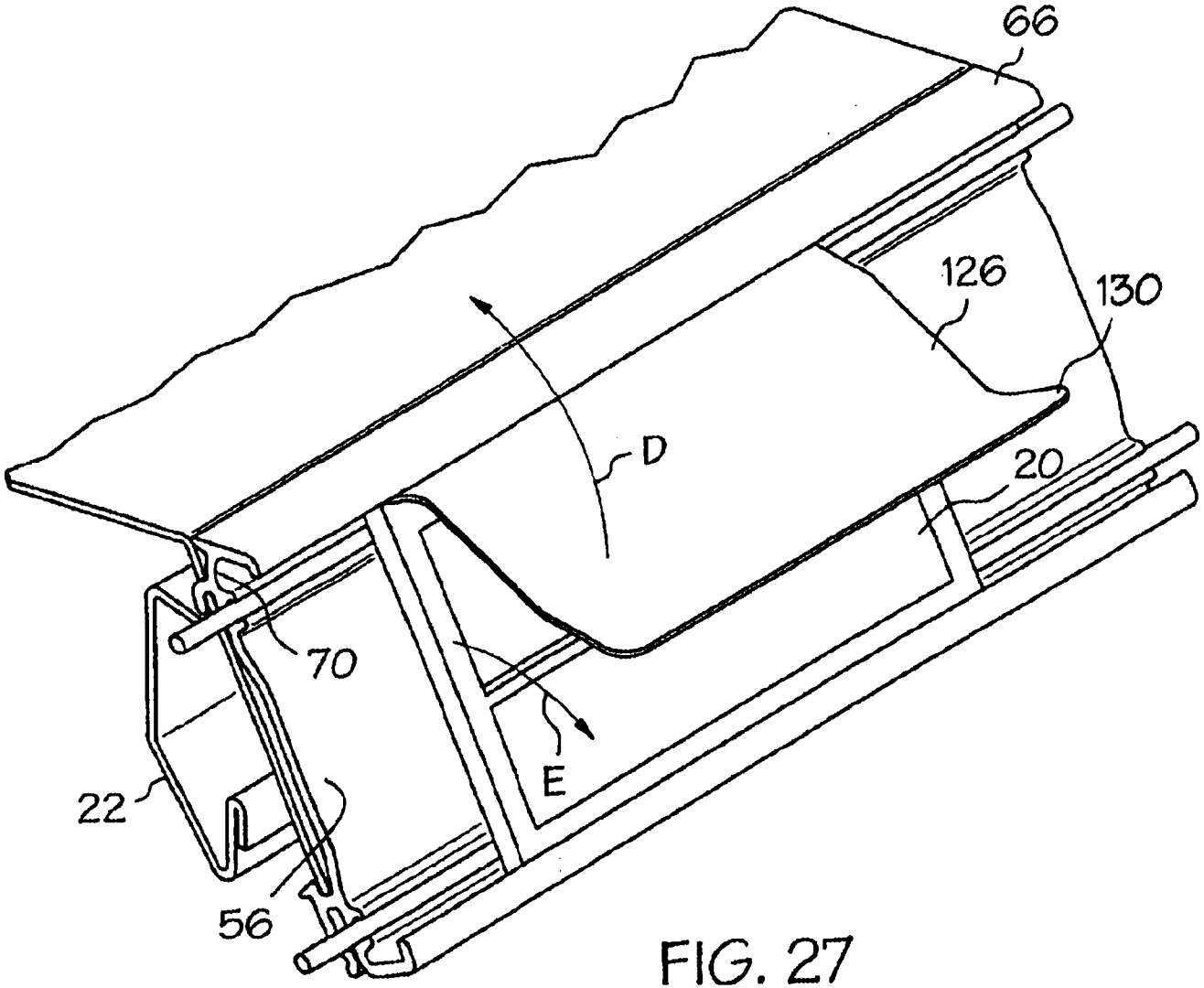
Figure 28:
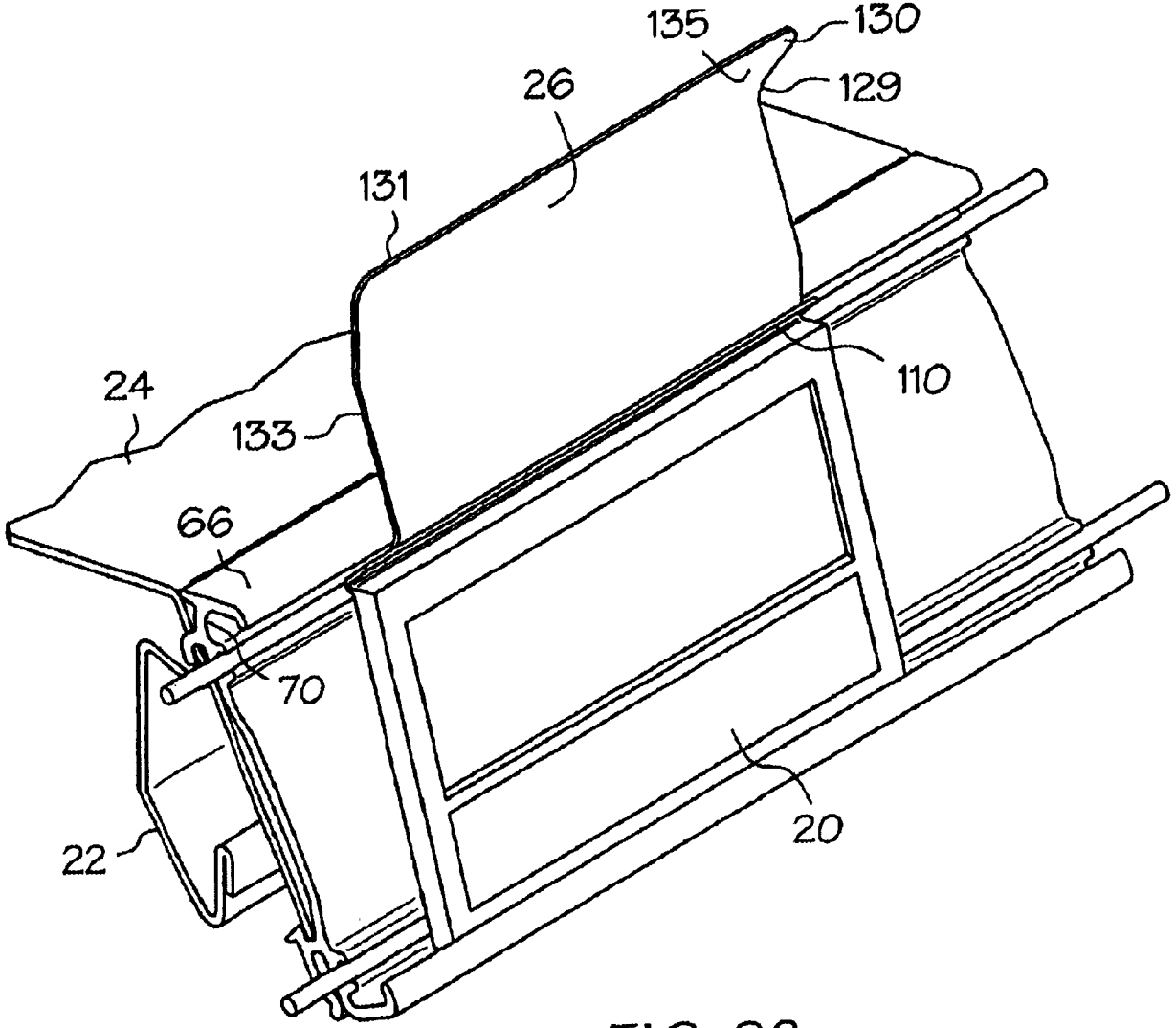

The sequence for using the tool 126 to remove a tag 20 from a rail 56 is shown in FIGS. 25–28. As shown in FIG. 25, the tool 126 is oriented such that the tool 126 is generally perpendicular to the tag 20. With reference to FIG. 26, the finger 130 is fit between the flexible tab 110 of the display tag 20 and the upper tag retaining flange 66 of the auxiliary rail 56 at one end of the tag 20. The tool 126 is then slid along the top of the length of the tag 20. As it is so moved, the tapered edge 129 of the finger engages the flexible tab 110 and urges the tab 110 downwardly and outwardly away from the tag retaining flange 66 of the auxiliary rail 56. The top edge 131 of the tool is pressed against the backing 59 (more specifically, the flexible upper arm portion 70) of the auxiliary rail 56. The backing 59 provides support to the tool 126 along the top edge 131 to help urge the tab 110 away from the tag retaining flange 66. The tool 126 may also simultaneously flex the tag retaining flange 66 upwardly and away from the tag tab 110. The tool 126 in then slid down the length of the tag 20 so that it engages the entire length of the tab 110. Once the tool has traversed the length of the tag 20, as shown in FIG. 27, the flexible tab 110 should be substantially disengaged from the auxiliary rail 56, and the tag 20 can be "popped" out of the rail 56. This is accomplished by rotating the tool 126 generally upwardly, as indicated by arrow D in FIG. 27. This action pops the tool outward in the direction indicated by the arrow E in FIG. 27. The tool 126 is preferably longer than the tab 110, so that the entire tab 110 can be engaged and displaced by the tool 126 at one time in order to pop out the tag. FIG. 28 illustrates that tag 20 and rail 56 when the flexible tab 110 is uncoupled from the upper tag retaining flange 66.

Figure 12B:
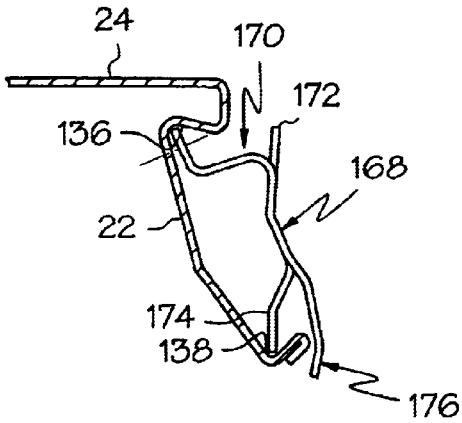
FIG. 12B is a side, cross sectional view of the bracket of FIG. 12A, shown mounted to a shelf edge.
Figure 12A:
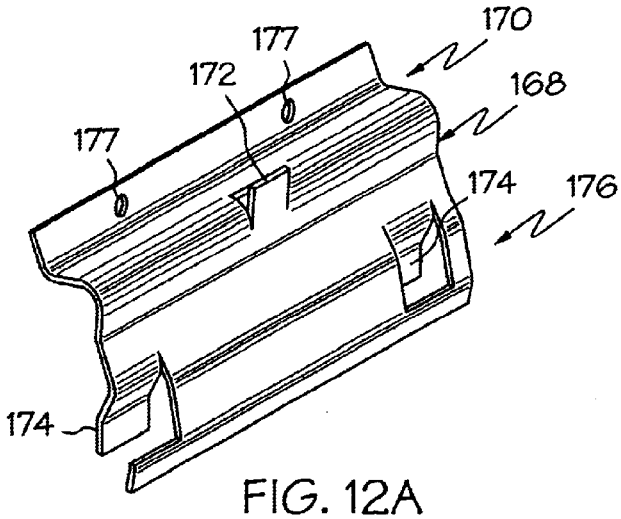
FIG. 12A is a front perspective view of an another embodiment of the shelf edge adapter bracket of the present invention.

FIGS. 12A and 12B illustrate an alternative shelf edge adapter bracket 168 that may be used to couple an auxiliary rail 56 to a shelf edge 22. The bracket 168 includes a central body portion 169, and is preferably formed from a single sheet of resilient sheet material, such as stainless spring stock. The bracket 168 may extend completely along the entire shelf edge 22, or the bracket 168 may be shorter in length so that a plurality of the brackets 168 are distributed along the length of the shelf edge 22. The bracket 168 includes an upper end segment 170 that acts as an upper flange to be received in a shelf edge 22. The upper end segment 170 is generally "S" shaped in side view to form a spring adapted to be retained within the upper groove 136 of the shelf edge 22. The upper end segment 170 also includes an upper tang 172. The tang upper 172 may be formed by cutting a set of slots in the upper segment 170 to define a tab, and bending the tab forwardly to form the upper tang 172. The upper tang 172 is located to be received in the upper slot 89 of the of the auxiliary rail 56. Longer versions of the bracket 168 may include a plurality of such tangs 172 along the length of the bracket.

The bracket 168 also includes one or more lower flanges 174. The lower flanges 174 may be formed by cutting two or three slots in the lower portion 176, and bending the resultant tabs rearwardly and downwardly in a substantially S-shape to form the lower flanges 174. In this manner, the lower flanges 174 may act as springs when they are received within in the lower groove 138 of the shelf edge 22. Longer versions of the bracket 168 may include a plurality of the lower flanges 174. The remaining lower portion 176 of the bracket 168 acts as a downwardly extending lower tang for being received in the lower slot 102 of the auxiliary rail 56. The upper end segment 170 may also include a plurality of holes 177 therethrough for receiving a fastener which may be used to secure the bracket 168 to the shelf edge 22. The upper tang 172 and the upper flange formed by the upper end segment 170 both extend upwardly relative the central body portion 169, and the lower flange 174 and lower tang formed by the lower portion 176 extend generally downwardly relative the central body portion 169.

Figure 13B:
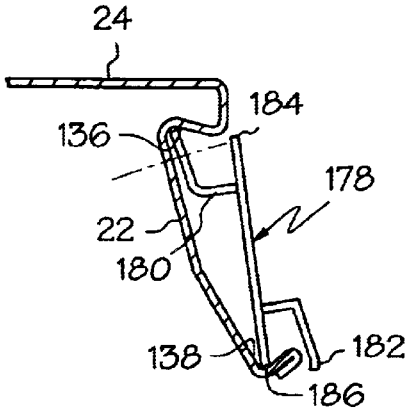
FIG. 13B is a side, cross sectional view of the bracket of FIG. 13A, shown mounted to a shelf edge.
Figure 13A:
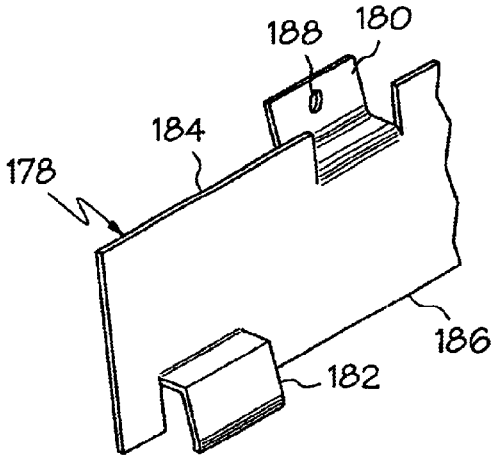
FIG. 13A is a front perspective view of an another embodiment of the shelf edge adapter bracket of the present invention.

FIGS. 13A and 13B illustrate another alternate embodiment of a shelf edge adapter bracket. The bracket 178 includes a pair of tabs 180, 182. The first tab 180 extends backwardly and upwardly to form an upper flange to be received in the upper groove 136 of the shelf edge 22. The second tab 182 extends forwardly and downwardly to act as a lower tang to be received in the lower slot 102 of auxiliary rail 56. Each tab 180, 182 is substantially "L" shaped in side view, and longer versions of the bracket 178 may include a plurality of such tabs 180, 182. The upper edge 184 of the bracket 178 provides an upper tang for being received in the upper slot 102 of auxiliary rail 56. The lower edge 186 provides a lower flange to be retained in the lower groove 138 of the shelf edge 22. The bracket 178 may include a hole 188 extending through the tab 180 for receiving a fastener to secure the bracket 178 to the shelf edge 22. As is the case with the earlier brackets, the upper tang 172 and lower flanges 174 may be formed by cutting a series of slots in the body of the bracket 178 to form a pair of tabs, and bending the resultant tabs into the desired position.

Figure 14B:
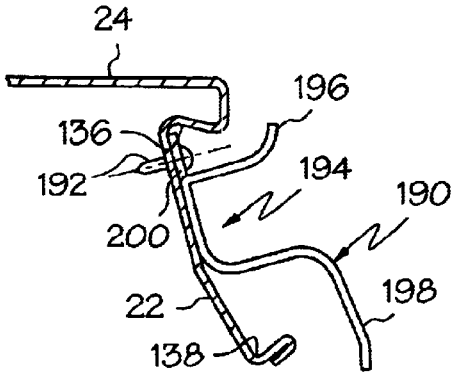
FIG. 14B is a side, cross sectional view of the bracket of FIG. 14A, shown mounted to a shelf edge by a fastener.
Figure 14A:
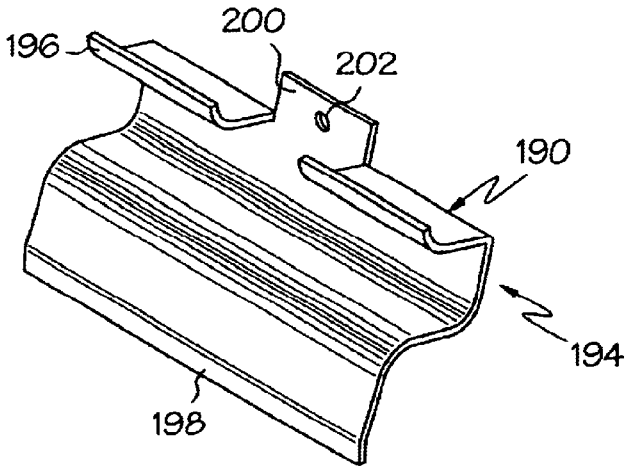
FIG. 14A is a front perspective view of an another embodiment of the shelf edge adapter bracket of the present invention.

Another alternate embodiment of the adapter clip is shown in FIGS. 14A and 14B. The bracket 190 includes a generally "U" shaped center segment or body 194 having an outwardly flared upper portion 196 and an outwardly flared lower portion 198. The upper portion 196 is curved upwardly so as to form an upper tang for being received in the upper slot 89 of auxiliary rail 56. The lower portion 198 of the U-shaped segment 194 is curved downwardly so as to form a lower tang for being received in the lower slot 102 of auxiliary rail 56. A retaining tab or mounting portion 200 extends away from the center segment 194 so as to lay flush against the inner wall of the shelf edge 22. The mounting portion 200 includes a hole 202 for receiving a sheet metal screw or another fastening device, such as a rivet, threaded bolt or the like. As shown in FIG. 14B, the fastener 192 may be passed through the mounting portion 200 for fastening the bracket 190 to the shelf edge 22. Longer versions of the bracket 190 may include a plurality of such tabs 200. The tab 200 may be formed by cutting a series of slots in the body of the bracket 190, and bending the resultant tab rearwardly with respect to the outwardly flared upper portion 196.

Figure 15A:
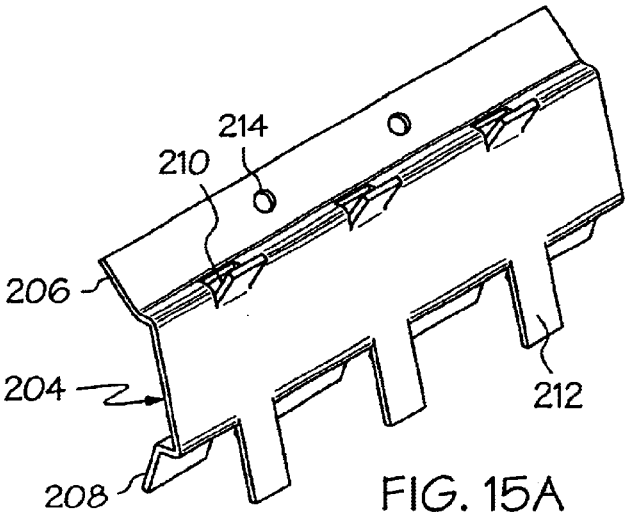
FIG. 15A is a front perspective view of an another embodiment of the shelf edge adapter bracket of the present invention.
Figure 15B:
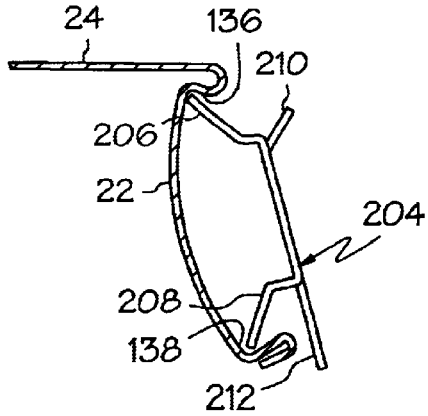
FIG. 15B is a side, cross sectional view of the bracket of FIG. 15A, shown mounted to a shelf edge.

Yet another alternate shelf edge adapter bracket 204 is shown in FIGS. 15A and 15B. The bracket 204 is generally "U" shaped in end view, and has an upper and lower flared edge portions 206, 208. The upper flared edge portion 206 is shaped to be retained in the upper groove 136 of the shelf edge 22, and the lower flared edge portion 208 is shaped to be retained in the lower groove 138 of the shelf edge 22. The bracket 204 includes at least one tab 210 that extends generally forwardly and upwardly to provide an upper tang for being received in the upper slot 89 of an auxiliary rail 56. The bracket 204 also includes a lower tab 212 extending generally forwardly and downwardly to provide a lower tang for being received in the lower slot 102 of an auxiliary rail 56. As shown in FIG. 15A, longer versions of the bracket 204 may include a plurality of upper and lower tabs 210, 212. Finally, the bracket 204 may include one or more holes 214 extending through the upper flared edge portion 206 for receiving a fastener to secure the bracket 204 to the shelf edge 22. The upper and lower tangs may be formed by cutting a series of slots in the body of the bracket 204 to define the tabs 210, 212, and bending the tabs 210, 212 forwardly with respect to the body of the bracket 204.

Figure 16A:
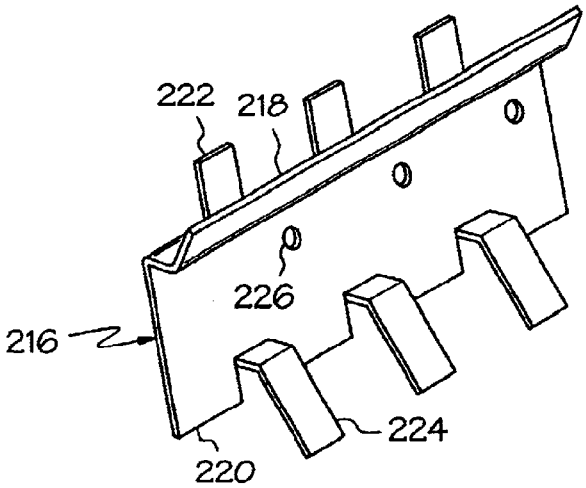
FIG. 16A is a front perspective view of an another embodiment of the shelf edge adapter bracket of the present invention.
Figure 16B:
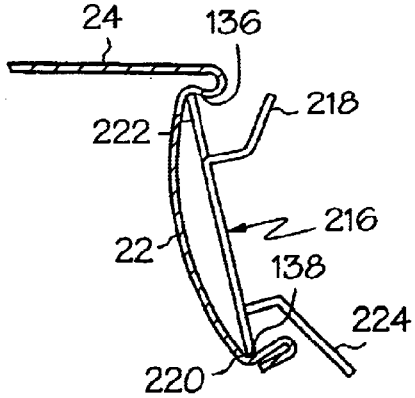
FIG. 16B is a side, cross sectional view of the bracket of FIG. 16A, shown mounted to a shelf edge.

Yet another alternate shelf edge adapter bracket 216 is shown in FIGS. 16A and 16B. The bracket 216 has upper and lower edge portions 218, 220. The upper edge portion 218 extends generally forwardly and upwardly to provide an upper tang for being received in the upper slot 89 of the auxiliary rail 56. The lower edge portion 220 acts as a lower flange to be received in the lower groove 138 shelf edge 22. The bracket 216 includes at least one upper tab 222 extending rearwardly and upwardly relative the upper edge portion 218. Each upper tab 222 provides a flange that is shaped to be received in the upper groove 136 of the shelf edge 22. The bracket 216 also includes at least one lower tab 224 extending forwardly relative the lower edge portion 220. Each lower tab 224 is extends forwardly and downwardly to provide a lower tang for being received in the lower slot 102 of an auxiliary rail 56. As shown in FIG. 16A, longer versions of the bracket 216 may include a plurality of the upper and lower tabs 222, 224. The bracket 216 may include a through hole 226 located at the central body portion thereof to receive a fastener to secure the bracket 216 to the shelf edge 22. The bracket 216 is preferably formed by bending a piece of sheet-like material to the general form of the bracket 216, and then cutting the upper and lower tabs 222, 224 out of the sheet-like material. The tabs 222, 224 are then bent rearwardly and forwardly, respectively, relative the sheet-like material to the desired positions.

Figure 17B:
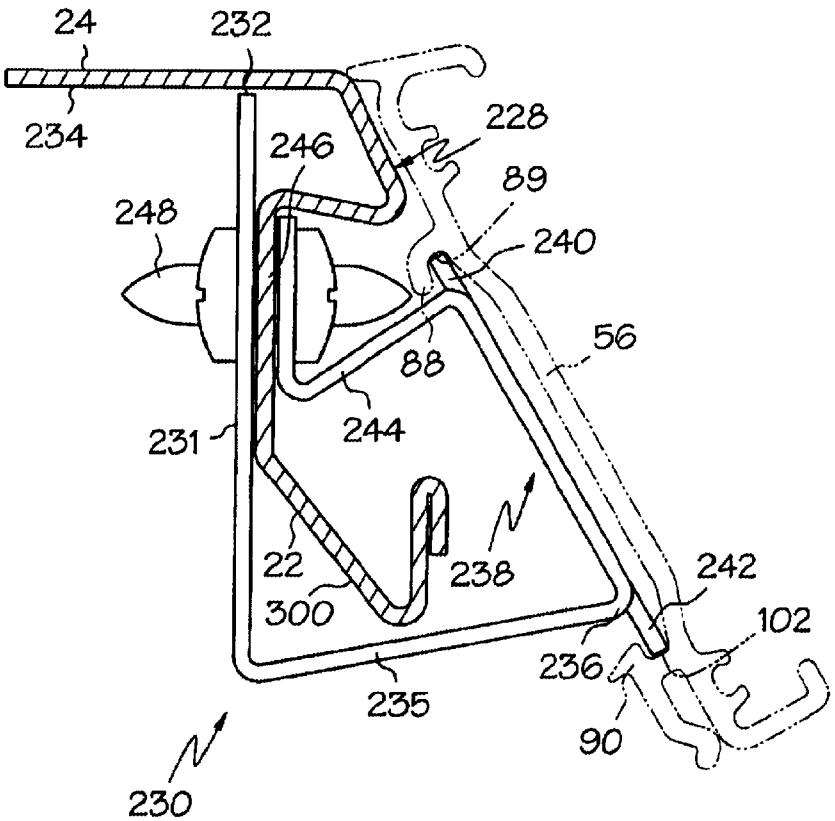
FIG. 17B is a side, cross sectional view of the bracket and shelf edge of FIG. 17A, the bracket shown mounted to an the shelf edge by a fastener, the bracket further shown being coupled to an auxiliary rail illustrated in hidden lines.
Figure 17A:
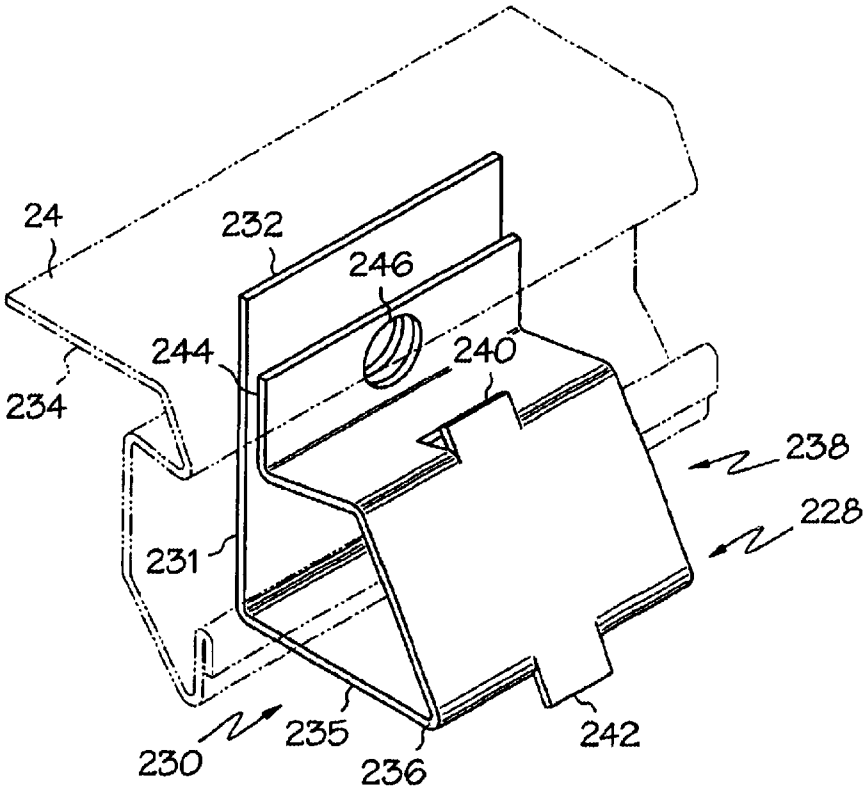
FIG. 17A is a front perspective view of an another embodiment of the shelf edge adapter bracket of the present invention, shown with an associated shelf illustrated in hidden lines.

Another embodiment of the present invention is shown in FIGS. 17A and 17B. The bracket 228 includes a generally "L" shaped backing portion 230 having a generally vertically extending rear mounting portion 231 and a lower segment 235. The rear mounting portion 231 is positioned behind the shelf edge 22 when the bracket 228 is mounted to a shelf edge 22, and lies flush against the rear surface 300 of the shelf edge 22. The rear mounting portion 231 has a top edge 232 adjacent to, or abutting against, the bottom surface 234 of the store shelf 24. The lower segment 235 extends forwardly below the lower edge of the shelf edge 22, and terminates in a front edge 236. An auxiliary rail mounting portion 238 extends generally upwardly from the front edge 236, and is angled slightly rearwardly from the front edge 236 of the lower segment 235. The auxiliary rail mounting portion 238 is shaped to be received in an auxiliary rail 56 to couple the bracket 228 to the auxiliary rail. An upper tab 240 extends generally upwardly from the auxiliary rail mounting portion 238 to form an upper tang that can be received in upper slot 89 of the auxiliary rail 56. A corresponding lower tab 242 extends generally downwardly to form a lower tang to be received in the lower slot 102 of the auxiliary rail 56.

A front mounting portion 244 extends generally rearwardly and downwardly from the rail mounting portion 238. The front mounting portion 244 curves back towards the rear mounting portion 231, and then curves upward to extend generally flush against the shelf edge 22. A through hole 246 extends through the front mounting portion 244, shelf edge 22, and rear mounting portion 231 for receiving a fastener 248 therethrough. The fastener may be a sheet metal screw, rivet or other mechanism for fastening the bracket 228 to the shelf edge 22. Longer versions of the bracket 228 may include a plurality of tabs 240, 242 and through holes 246. In one embodiment, the bracket is formed by cutting a set of slots to define the upper tab 240 and lower tab 242, and the backing portion 230 and front mounting portion 244 are bent away from the auxiliary rail mounting portion 238 to their desired shape.

Figure 18A:
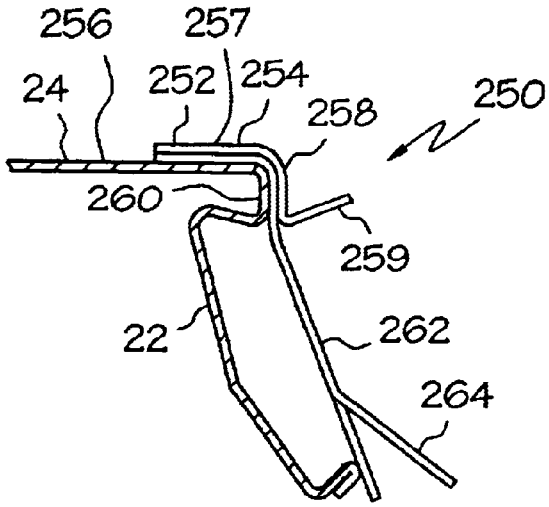
FIG. 18A is a side, cross sectional view of another embodiment of the shelf edge adapter bracket of the present invention, shown mounted to a shelf edge.
Figure 18B:
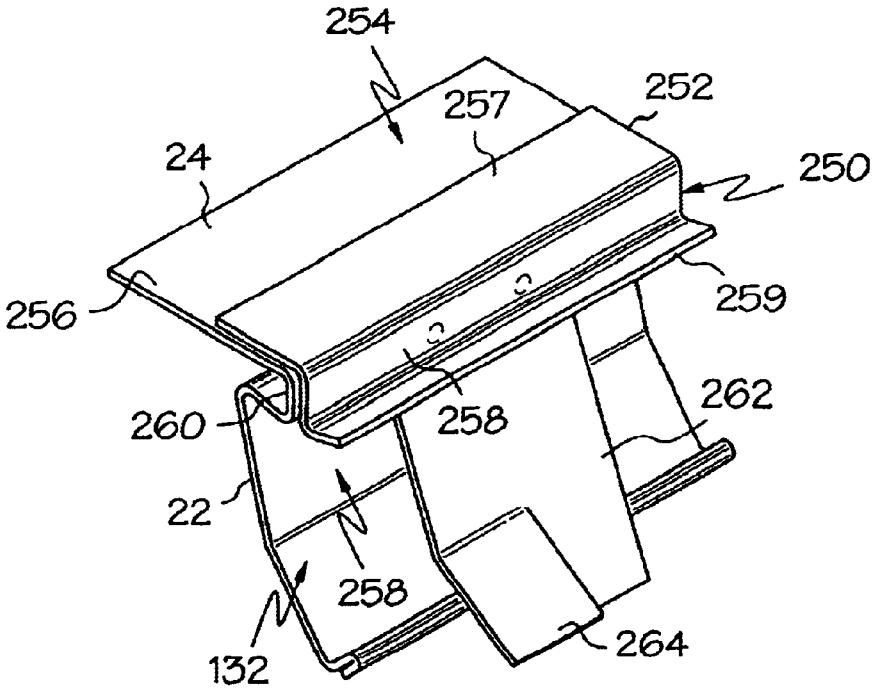
FIG. 18B is a front perspective view of the shelf edge adapter bracket and shelf edge of FIG. 18B.

As shown in FIGS. 18A and 18B, another alternate shelf edge adapter bracket 250 includes a first plate 252 having a flat horizontal rear segment 254. The horizontal segment 254 may be seated on the top surface 256 of the store shelf 24. The first plate 252 is generally "Z" shaped in side view, and includes a top portion 257 shaped to overlay the top surface 256, a middle portion 258 that extends over the front edge 260 of the shelf 22, and a lower portion that acts as an upper tang 259. A second plate 262 of sheet-like material, such as stainless spring stock, is fastened to the rear surface of the first plate 252. The second plate 262 extends downwardly in front of the shelf edge 22, and is attached to the middle portion 258 of the first plate 252. The second plate 262 includes a tab 264 extending generally forwardly to provide a lower tang for being received in the lower slot 102 of the auxiliary rail 56. The first plate 252 of the bracket 250 may be mounted to the shelf 24 using sheet metal screws, rivets or any other attachment devices commonly known. The first plate 252 preferably extends substantially the entire length of the shelf 24, and a plurality of the second plates 262 may be distributed along the length of the shelf 24 to provide a secure retainer for the auxiliary rail 56. The first and second plates 252, 262 may be joined by welding or other means, or may be a unitary piece of material.

Figure 19A:
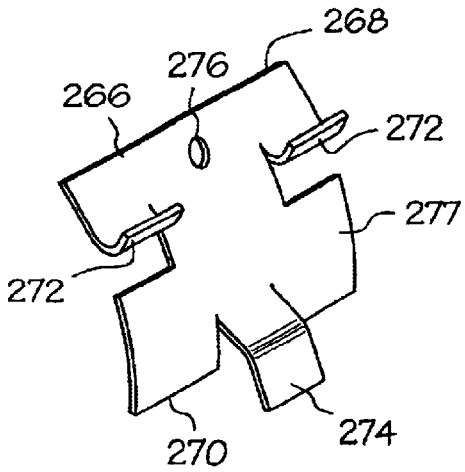
FIG. 19A is a front perspective view of an another embodiment of the shelf edge adapter bracket of the present invention.
Figure 19B:
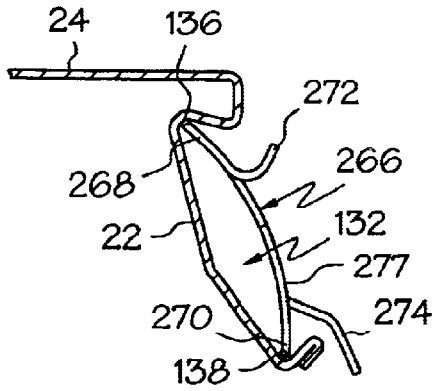
FIG. 19B is a side, cross sectional view of the bracket of FIG. 19A, shown mounted to a shelf edge and in an unsecured position.
Figure 19C:
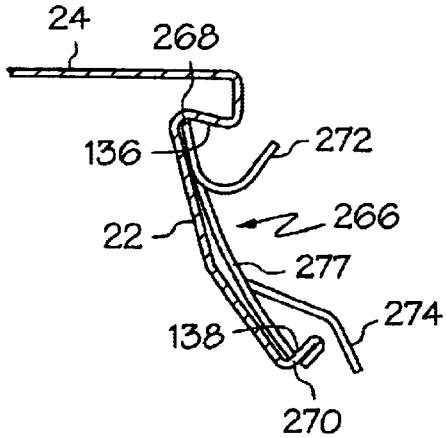
FIG. 19C is a side, cross sectional view of the bracket of FIG. 19A, shown mounted to a shelf edge and in a secured position.

Yet another alternate shelf edge adapter bracket is shown in FIGS. 19A–C. The bracket 266 includes an upper edge 268 and lower edge 270. In order to mount the bracket 266 to the shelf edge 22, the upper edge 268 is located within the upper groove 136 of the shelf edge 22, and the lower edge 270 is located within the lower groove 138. The bracket 266 has a vertical height (i.e. the distance between the upper edge 268 and lower edge 270) that is slightly greater than the distance between the upper and lower grooves 136, 138. Thus, when mounting the bracket 266, it will assume the unsecured position shown in FIG. 19B where the bracket 266 is bowed away from the shelf edge 22. A pressure is then applied to the front side 277 of the bracket 266 such that it is "snapped" into the shelf edge 22 in a cam over fashion, and is therefore bowed (or compressed) inwardly to fit within the shelf edge 22, as shown in FIG. 19C. The bracket 266 is shown in its secured position in FIG. 19C.

The bracket 266 includes a pair of cutout tabs 272 that extends generally forwardly and upwardly with respect to the body of the bracket 266. The tabs 272 acts as upper tangs for being received in the upper slot 89 of an auxiliary rail 56. A lower tab 274 extends generally forwardly and downwardly act as a lower tang for being received in the lower slot 102 of an auxiliary rail 56. The tabs 272, 274, are preferably formed by cutting a set of slots in the body of the bracket 266, and bending the tabs 272, 274 away from the body of the bracket 266 to the desired shape.

Figure 20A:
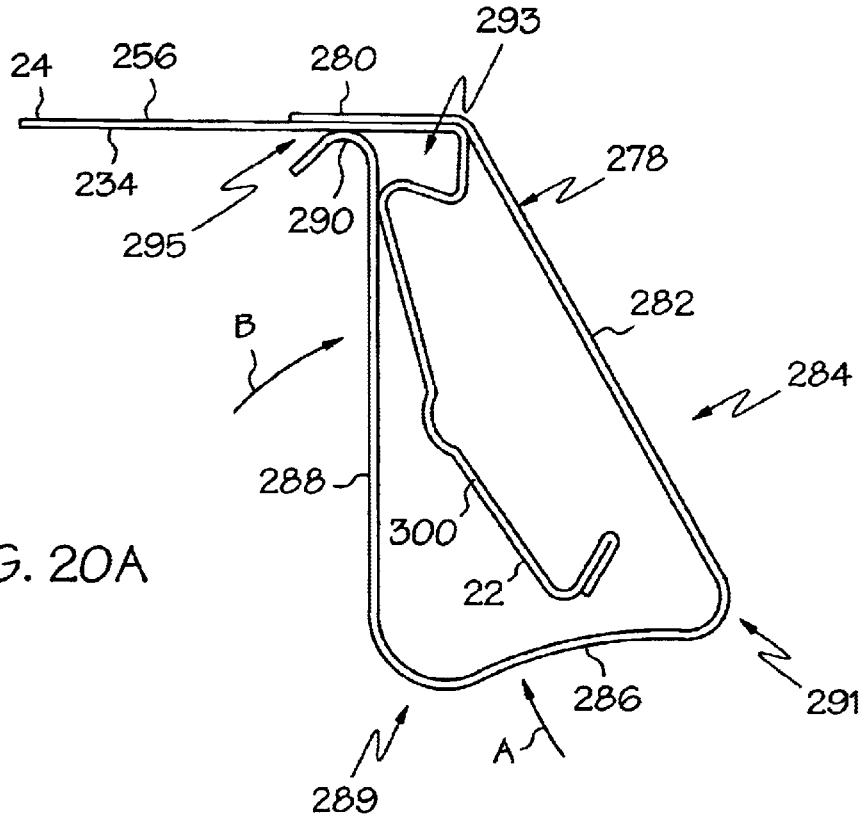
FIG. 20A is a side, cross sectional view of an another embodiment of the shelf edge adapter bracket of the present invention, shown mounted to a shelf edge.
Figure 20B:
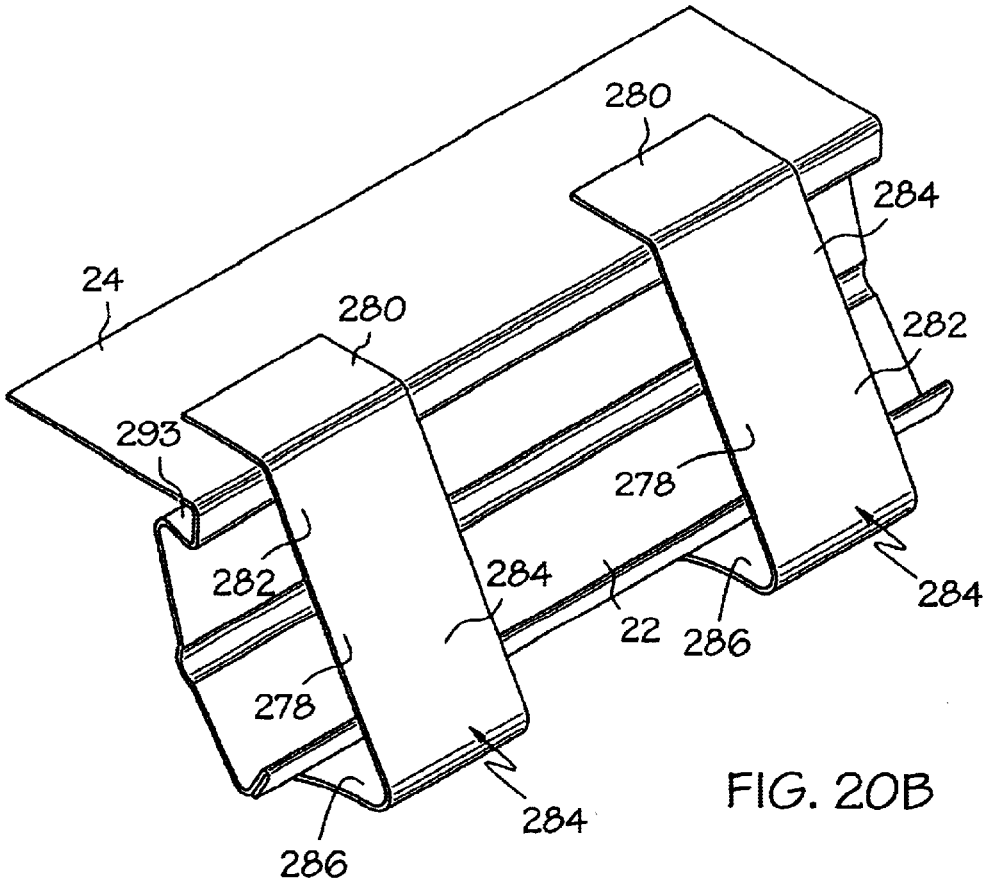
FIG. 20B is a front perspective view of the bracket and shelf edge of FIG. 20A.

FIGS. 20A and 20B illustrate yet another concept for providing uniform platform for attaching the auxiliary rails 56 thereto. The bracket 278 is essentially a spring clip, and is shaped to encompass the shelf edge 22. The bracket 278 utilizes primarily the top surface 256 and the bottom surface 234 of the shelf 24 to secure the bracket 278 to the shelf 24. The bracket 278 includes a first generally horizontal segment, or top cap 280 adapted to be seated on the top surface 256 of the shelf. A face portion 282 extends generally downward from the top cap 280 at a slight angle to provide a uniform platform 284 attaching the auxiliary rail 56 thereto. A substantially horizontal spring portion, or bottom portion 286 extends generally rearwardly from the face portion 282, and extends below the shelf edge 22. A vertical spring portion, or rear portion 288 extends generally upwardly from the bottom portion 286. The rear portion 288 includes a barbed segment 290 at an upper edge thereof for abutting the bottom surface 234 of the shelf 24. The bottom portion 286 is biased in the direction shown by arrow A when the bracket 278 is mounted on the shelf edge 22, and the rear portion 288 is biased in the direction shown by arrow B when the bracket 278 is mounted on the shelf edge 22. Thus, the bottom portion 286 and rear portion 288 are biased such that the rear portion 288 is urged against the rear surface 300 of the shelf edge 22 and the bottom surface 234 of shelf 24. The rear portion 288 and bottom portion 286 thereby act as springs to provide the force to hold the top cap 280 and barbed portion 290 against the top and bottom surfaces of the shelf, 256, 232 respectively. The spring constant of the bottom portion 286 is preferably greater than the spring constant of the rear portion 288.

The top cap 280 may be affixed to the top surface 256 of the shelf to maintain the bracket 278 on the shelf edge. Alternately, the top cap 280 and top surface 256 may include interengaging geometries to retain the top cap 280 on the top surface 256. For example, the top cap may include one or more dimples that are shaped to be received in a corresponding groove in the top surface 256 of the shelf 24. Of course, a variety of methods may be used to achieve similar results.

In order to remove or attach the bracket 284, the rear portion 288 is pivoted around pivot point 289, and the bottom portion 286 is pivoted around pivot point 291 until there is enough clearance to slide the shelf edge through the opening 295 at the top of the bracket 284. The face portion 282 provides a platform 284 upon which the auxiliary rail 56 may be mounted by fasteners, adhesives, or other methods. The barb 290 may alternately extend into the recess 293 above the shelf edge 22 to help retain the bracket 284 on the shelf edge.

Figure 21A:
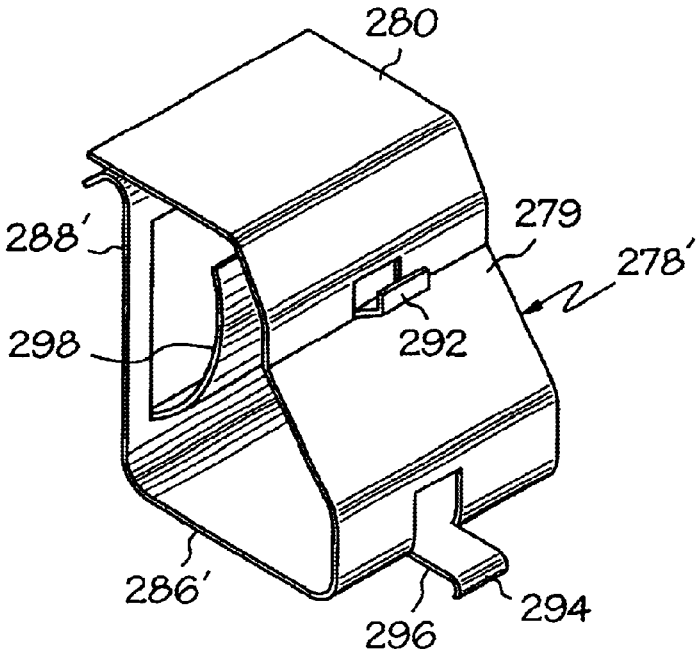
FIG. 21A is a front perspective view of an another embodiment of the shelf edge adapter bracket of the present invention.
Figure 21B:
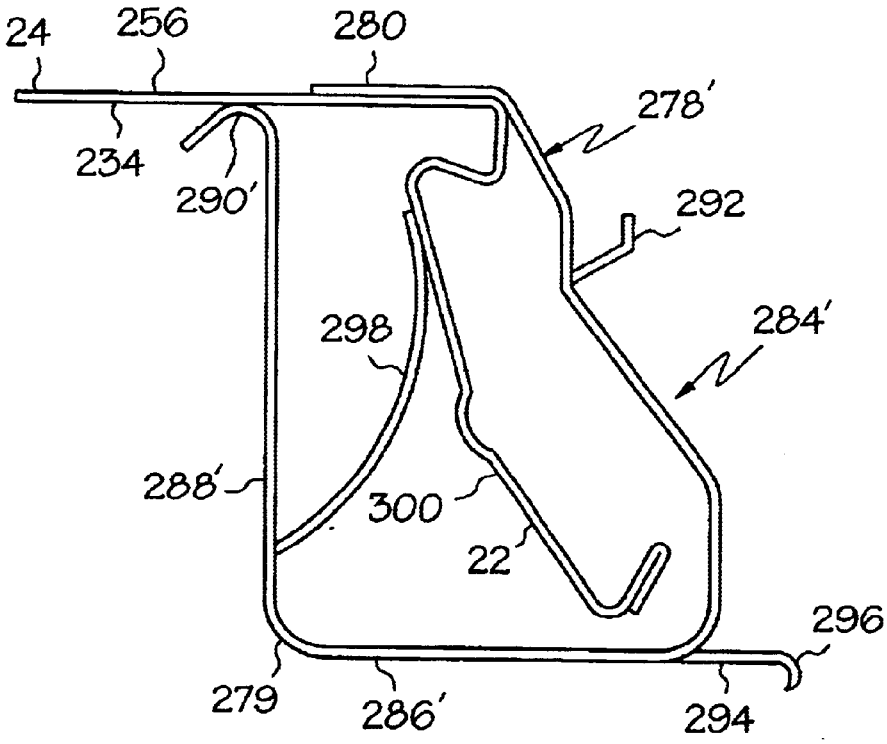
FIG. 21B is a side, cross sectional view of the bracket of FIG. 21A, shown mounted to a shelf edge.

FIGS. 21A and 21B illustrate an alternate version of the bracket shown in FIGS. 20A and 20B. The bracket 278' includes a body portion 279 shaped to wrap around the shelf edge 22 to thereby couple the bracket to the shelf edge 22. The bracket 278' is held in place in generally the same manner as the bracket 278, but includes a third cut out tab, or rear spring 298 extending forwardly and upwardly from the rear portion 288' to provide a third spring for abutting the rear surface 300 of the shelf edge 22. Preferably the spring constant of the bottom portion 286' is larger than the spring constant of the rear portion 288', which is in turn larger than the constant of the rear spring 298. The mounting surface 284' of the bracket 278' includes an upper tab 292 extending outwardly and upwardly to form an upper tang for being received in the upper slot 89 of an auxiliary rail 56. A lower tab 294 extends generally outwardly from the bottom portion 286', and has a downwardly curved barb 296 to act as a lower tang for being received in the lower slot 102 of an auxiliary rail 56.

Figure 22A:
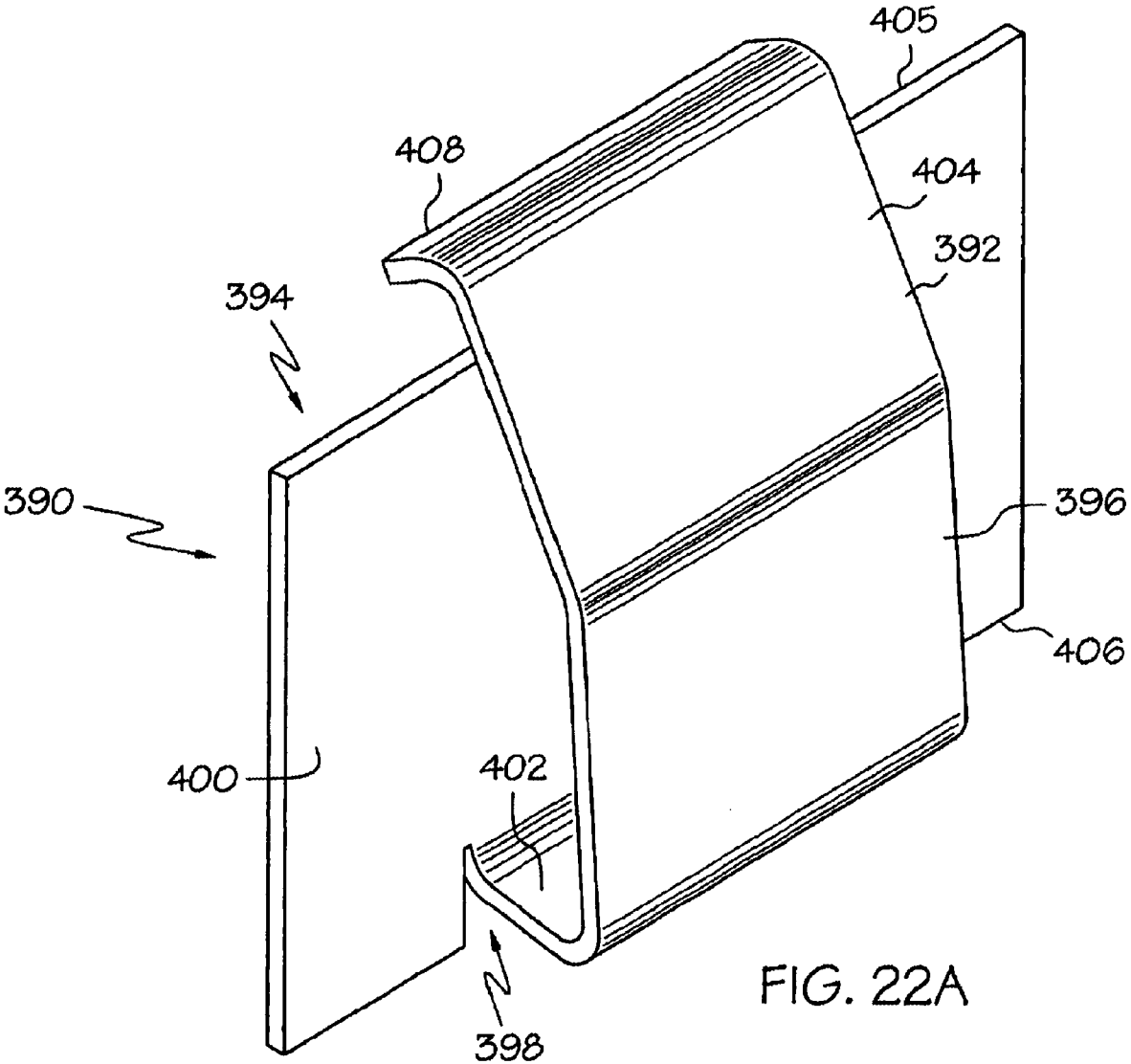
FIG. 22A is a front perspective view of an another embodiment of the shelf edge adapter bracket of the present invention.
Figure 22B:
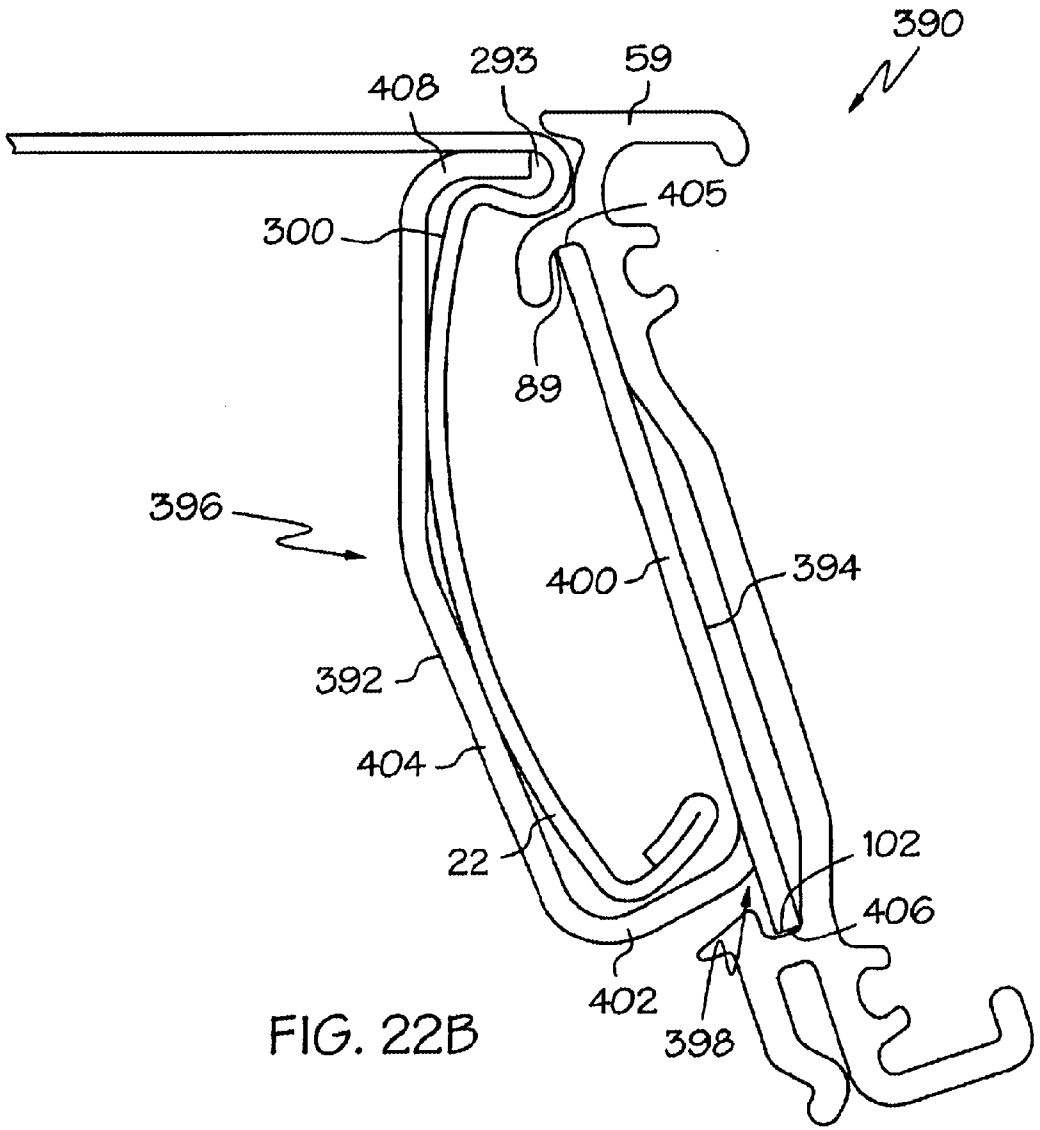
FIG. 22B is a side, cross sectional view of the bracket of FIG. 22A, shown mounted to a shelf edge.

FIGS. 22A and 22B illustrate another embodiment of a bracket design that is similar in principle to the brackets 278, 278' of FIGS. 20A, 20B and FIGS. 21A, 21B. The bracket 390 includes a body portion 392 that is shaped to wrap around the shelf edge 22 to thereby couple the bracket 390 to the shelf edge 22. The body portion 392 includes a front plate 394 and a rear plate 396. As shown in FIG. 22A, a pair of laterally extending slots 398 extend between the front plate 394 and rear plate 396. The front plate 394 includes a face portion 400 that is located in front of the shelf edge 22. The rear plate 396 includes a bottom portion 402 extending below the shelf edge 22 and a rear portion 404 extending behind the shelf edge 22. The face portion 400 includes an upper edge 405 and a lower edge 406 that form an upper and lower tang, respectively, for being received in the upper slot 89 and lower slot 102 of auxiliary rail 56, respectively.

The bottom portion 402 is biased to urge the rear portion 404 against the rear surface 300 of the shelf edge 22. The rear portion 404 is shaped to generally conform to the shape of the shelf edge 22, and may also be shaped to be biased against the shelf edge 22 when mounted thereon. The rear portion 404 includes a barb 408 that extends into a recess 293 on the rear surface 300 of the shelf edge 22, and the barb 408 helps to retain the bracket 390 mounted on the shelf edge 22. The bracket 390 is preferably formed from a single piece of sheet-like material, and may be formed by bending the bottom plate 396 relative to the front plate 394 at the laterally extending slots 398. The bottom plate 396 may then be bent to the shape shown in FIGS. 22A and 22B to form the bottom portion 402 and rear portion 404.

For all of the brackets and clips discussed herein, unless noted otherwise, each bracket or clip can either be sized so as to have a single bracket or clip extending along the entire length of the shelf edge, or can be sized so as to have a number of the brackets or clips located along the length of the shelf edge. Furthermore, each bracket may be formed from a variety of materials, including nearly any sheet like material such as stainless spring stock, ferrous or non ferrous alloys, PVC, stainless steel, and the like.

When the auxiliary rails 56 are mounted on the adapter brackets, each rail extends from the shelf at an angle. As noted earlier, it may be desirable to vary this angle to when the rail is located at differing heights of shelves to improve the visibility of the tag 20 contained within the rail 56. To this end, it should be noted that the angle of the auxiliary rail 56 can be easily modified by changing the shape, angle, and lengths of the various tangs and flanges to effect differing orientations of the rail and tag. Thus, differing shapes of brackets may be used on differing shelves to achieve the desired viewing angle.

All of the brackets and clip may also include a co-extruded tip; that is, the edges of the upper and lower flanges that are received in the upper 136 and lower 138 groove of the shelf edge 22 may be formed of a generally flexible, pliable material. Similarly, the tips of the upper and lower tangs that are received in the upper 89 and lower 102 slot of the auxiliary rail may also be co-extruded. Alternately, instead of being formed completely from the coextruded material, the tips of the tangs and flanges may be coated or covered with a flexible, co-extruded material. The flexibility of the co-extruded tips help to account for any variations in the sizes of the shelf edges (i.e. the distance between the upper groove and the lower groove or upper and lower slot) due to manufacturing tolerance. The co-extruded tips also allow the bracket to be received in different types of shelf edges, such as shown in FIGS. 10A, 10B and 10C. The coextruded tips also provide a surface that frictionally engages the shelf edge 22 or auxiliary rail 56, which helps to retain the brackets in the shelf edge 22 or rail 56.

It should also be noted that many of the tabs, tangs, and flanges discussed herein may be formed by cutting a series of slots into the body of the bracket to form a tab, and bending the portion of the material defined by the cuts (i.e. the tab) away from the body of the cut material. It should evident that the number of cuts required depends upon the shape and location of the tab to be formed. For example, in order to form a rectangular tab in the middle of a body of material, three cuts forming three sides of a rectangular tab may be cut into the material. The material defined by the cut may then be bent around the uncut side of the "rectangle" to form a tab (i.e. tab 210 in FIG. 15A). The number of required cuts also depends upon the shape of the desired tab. For example, only two cuts are required to define a triangular tab in the middle of a sheet of material.

The location of the tab also determines the number of cuts required. Thus, when a rectangular tab is formed at the edge of a piece of material, only two cuts are needed (i.e. tab 182 in FIG. 13A or tab 174 in FIG. 12A). When a rectangular tab is formed at the corner of a piece of material, only one cut is needed (i.e. tab 264 in FIG. 18). Thus, when a tab, tang, flange, or the like is to be cut, it may be formed by cutting a set of slots, and the location and number of slots depends upon the shape and location of the tab. It should be understood that in the above description, various tabs, tangs, and cutouts are defined by describing and illustrating the type and location of the cuts. However, it should be understood that nearly any method for forming the desired tabs may be used without departing from the scope of the invention. Thus the number and types of cuts described to form a tab may vary beyond those described, as well as the shape and location of the tab.

It should also be understood that many of the flanges, tabs, tangs and the like are described herein by describing the "cutting" of material and "bending" of the defined tab to the desired shaped. These terms and descriptions are not intended to limit the scope of the invention, as it should be evident that the same results may be obtained through other methods, for example, by forming parts through molding or extrusion processes. Finally, a tab may be described as being bent, for example, "rearwardly" with respect to a piece of sheet-like material. It should be understood that the same results may be obtained by bending the sheet-like material forwardly with respect to the tang. In sum, the relative shapes and positions of the brackets and components described, illustrated, and claimed herein are not limited to the described method of forming that bracket or component unless otherwise noted.

The components and construction of the tag 20 and auxiliary rail 56 will now be described in greater detail. Referring again to FIG. 24, the tag 20 includes a body 11 having a front surface 113 and a rear surface 117. The tag is preferably constructed so as to ensure adequate inductive coupling between the pick up coil 54 in tag 20 and the conductor C in the auxiliary rail 56. The rear surface 117 of the tag 20 includes a vertically extending projection 118. The projection 118 is shaped to abut against the upper bead 82 of the lower protruding channel 78 on the auxiliary rail 56. The projection 118 is located such that when the projection 118 rests on the upper bead 82, the lower portion 93 of the pick up coil, or conductive coil 54 is located adjacent the lower portion 63 of the conductor or conductive loop C retained in the lower channel 78. This ensures proper communication between the pick up coil 54 and conductor C (i.e. through inductive coupling). The upper portion 95 of the pick up coil 54 is preferably located within the tag 20 to be adjacent the upper portion 65 of the conductor C that retained in the upper channel 76. The auxiliary rail 56 includes a recess 119 to receive the projection 118 therein, and the projection 118 preferably extends along the entire length of the tag 20.

The projection 118 may be shaped and located to engage any protrusion that extends into the channel 73 of the auxiliary rail. All that is required is that the projection engage a protrusion such that the lower portion 93 of the pick up coil 54 is located adjacent the lower portion 63 of the conductor C, and/or the upper portion 95 of the pick up coil 54 is located adjacent the upper portion 65 of the conductor C. Although in the illustrated embodiment the protrusion is the lower channel 78, nearly any type of protrusion may be used. Alternately, the protrusion for vertical registration may extend from the auxiliary rail 56, and be received in a recess in the tag 20. All that is required is that the tag 20 cooperate with the rail 56 to achieve the desired inductive coupling between the pick up coil 54 and conductor C.

As best shown in FIG. 5, the display tag 20 preferably includes a plurality of downwardly extending, laterally spaced bosses 120 that define a groove or recess 122 therebetween. Each boss 120 has a pair of vertical faces 124, and the boss extends generally downwardly from the body 11 of the tag 20. The vertical faces 124' are located adjacent the groove 122, and the outer vertical faces 124 are located near the outside edges of the tag 20. The auxiliary rail 56 may be provided with a plurality of small protrusions 84 extending upwardly from the tag support surface 86 (FIG. 4), and the protrusions 84 are preferably evenly distributed along the length of the auxiliary rail. The groove 122 on the tag 20 is preferably formed on the lower surface 114 of the tag 20, and is located adjacent the lower flange 68 when the tag 20 is received in an auxiliary rail 56. The protrusions 84 are provided such that the vertical faces 124 of the bosses 120 will abut against at least one of the protrusions 84 if the display tag 20 is attempted to be horizontally slid within the auxiliary rail 56. Accordingly, the combination of the small protrusions 84 and the downwardly extending vertical faces 124 formed by the downwardly extending bosses 120 block substantial horizontal movement of the display tags 20 along the auxiliary rail 56. The recess is preferably longer than the protrusions 84, such that the protrusions 84 may be received in the groove 122 to block the sliding of the tag 20 by engaging the vertical walls 84' adjacent the groove 122. When a protrusion is received in the groove 122, it may block lateral movement of the tag 20 in both lateral directions by engaging the inner vertical walls 124. Alternately, the protrusions 84 may block the sliding of the tag by engaging the outer vertical walls 124. In this case, a single protrusion can block the sliding of the tag 20 in only a single direction, although other protrusions 84 spaced along the rail 56 can block the lateral movement of the tag 20 in the other lateral direction.

The protrusions 84 may be nearly any desired shape that can engage the vertical faces 124 and block the sliding of the tag. It should further be understood that the protrusions 84 need not extend from the lower flange 68, and may extend from the upper flange 66, or from any other surface. All that is required is that the protrusions extend into the channel to block the lateral movement of the tag 20 in at least one, and preferably two, directions.

Figure 29:
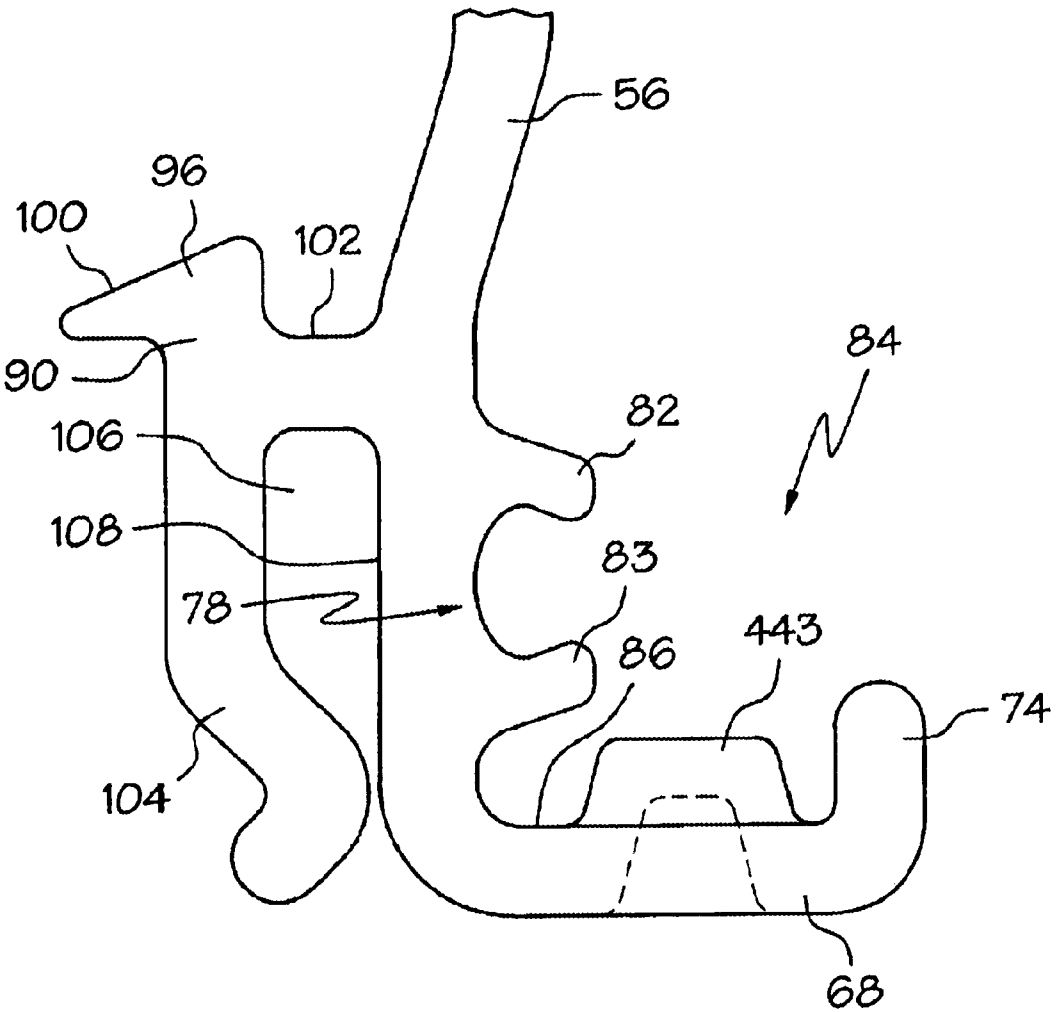
FIG. 29 is a detail side view of the bottom of an auxiliary rail.
Figure 31:
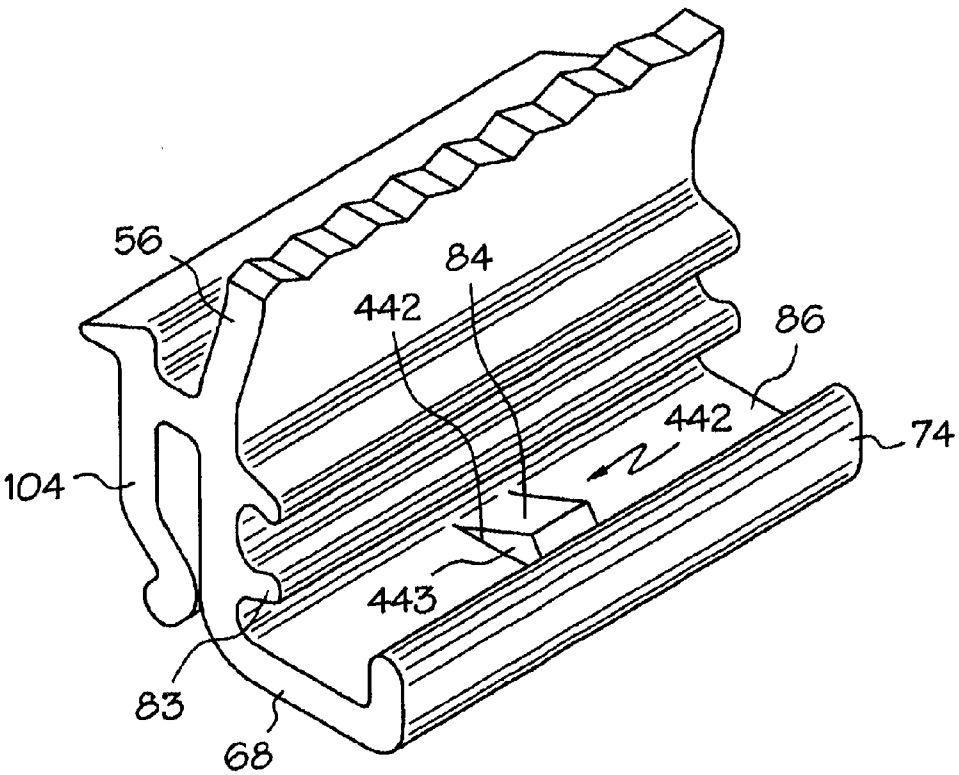
FIG. 31 is a front perspective view of the auxiliary rail portion of FIG. 30.
Figure 30:
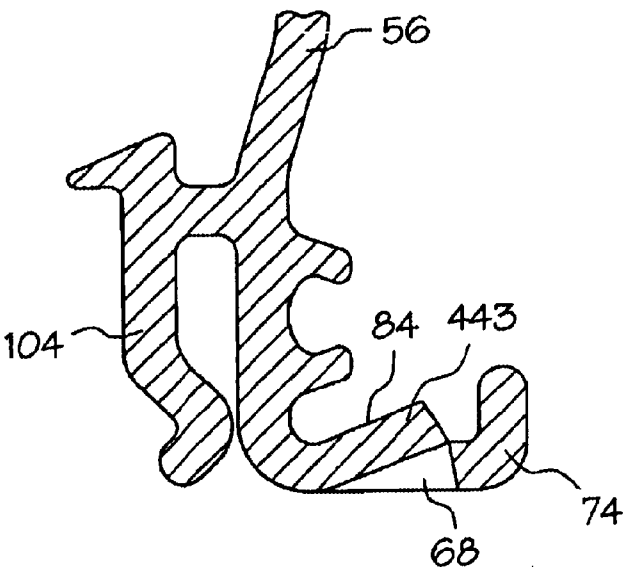
FIG. 30 is a detail, cross sectional side view of the bottom of an alternate embodiment of an auxiliary rail.

As shown in FIGS. 29–31, the protrusions 84 preferably provide a flat planar end surface 443 that is perpendicular to the motion of the tag to oppose the lateral sliding of the tags. In the embodiment illustrated in FIG. 29, the protrusion 84 is generally rectangular in top view. However, nearly any desired shape of protrusions 84, including generally circular in top view, may be used. The end surface 443 of the protrusions 84 may be generally trapezoidal in end view, as shown in FIG. 29. Alternately, the end surface 443 may be generally triangular in side view, as shown in FIGS. 30–31, resulting in a generally "ramp" shaped protrusion 84. Of course, the end surface 443 may be a variety of shapes other than triangular and trapezoidal, including rectangular, semicircular, etc. The protrusions may be formed when the rail 56 is extruded, or may be formed used a punch and die to punch out the protrusions 84 from the tag support surface 86 of the lower tag retaining flange 68. When formed with a punch and a die, the end surface 443 may be sheared away from the tag support surface 86 of the lower tag retaining flange 68, resulting in a pair of slots 442 in the tag support surface 86 (FIG. 31) In yet another embodiment, the protrusions may extend from the tag 20, and may be shaped to engage structure within the rail 56 to block the movement of the tag 20.

As shown in FIG. 29, the auxiliary rail 56 also includes a downwardly extending clip arm 104 that extends from the lower hook 90. The clip arm 104 defines a channel 106 between the arm 104 and the rear lower face 108 of the auxiliary rail 56, and bends inwardly to contact the rear lower face 108. The clip arm 104 is biased against the rear lower face 108 so as to form a paper clip type mechanism for retaining small articles such as paper, cards, coupons, and the like in the channel 106. It should be noted that the removal tool 126 (FIG. 7) may also be used to place articles in and remove articles from the channel 106. An edge 131, 133 of the tool 126 may be inserted into the channel 106 and rotated to urge the clip arm 104 away from the rear lower face 108. In this manner, articles may be easily inserted into and removed from the channel 106. Of course, other tools that have a flat edge may be into the channel 106 to accomplish the same result. Furthermore, it may not even be necessary to use any tool at all, as items may be able to be inserted into and withdrawn from the channel 106 by hand. For example, by pressing against the projection 96, the clip arm 104 may be urged away from the rear lower face 108 by a lever action.

Figure 32:
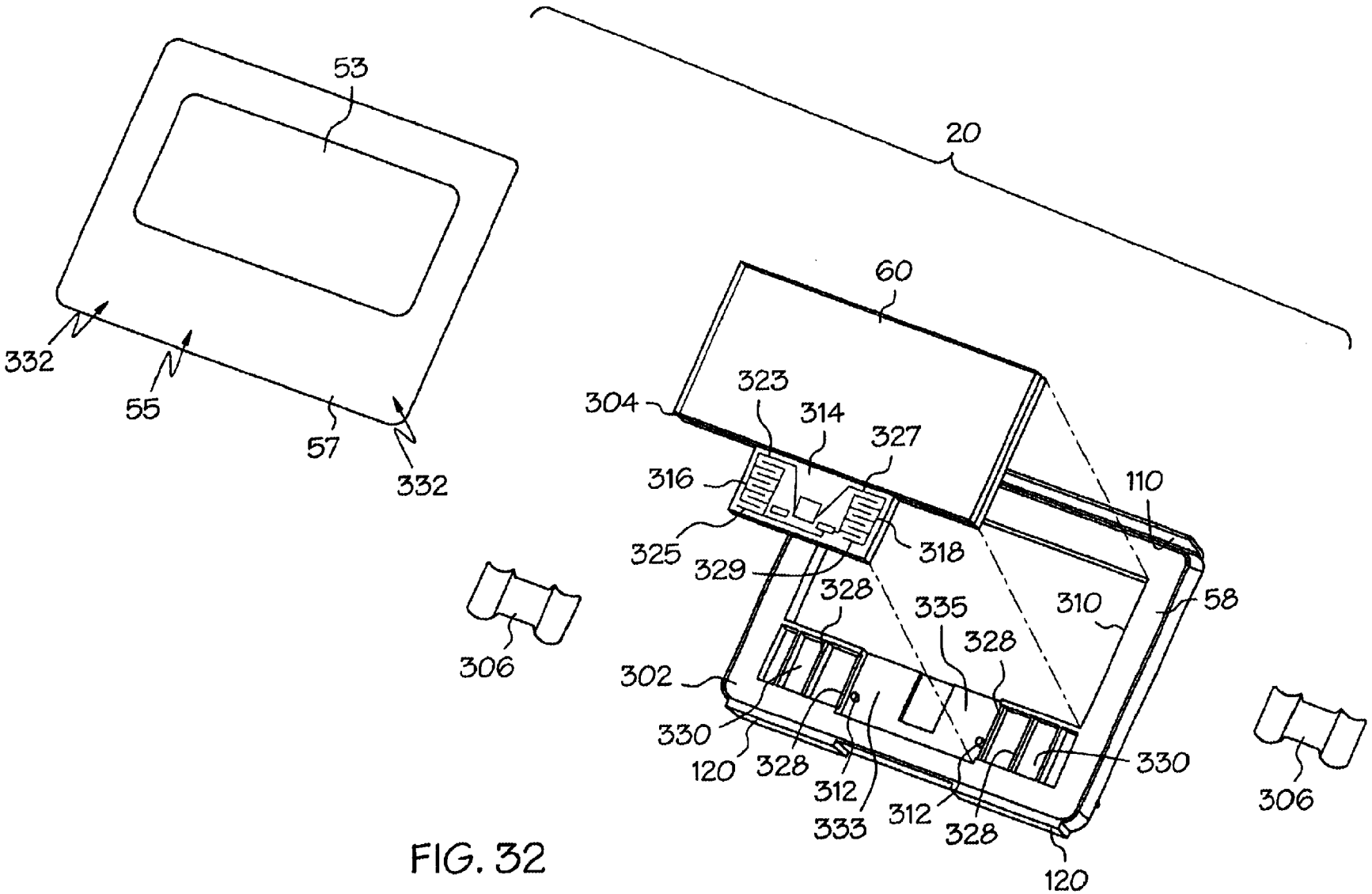
FIG. 32 is an exploded, perspective view of the tag of the present invention.

The construction of the tags 20 is now discussed in greater detail. As shown in FIG. 32, each display tag 20 preferably includes a bobbin assembly 302, a display board 304, a pair of switch plates 306, and a protective overlay 57. The bobbin assembly 302 includes a substantially rectangular recess 310 in which the display board 304 is received. The display board 304 may be secured in the bobbin assembly 302 using an epoxy, glue, tape or any other means. The bobbin assembly 302 includes a pair of posts 312 for receiving the display board 304, and the display board 304 preferably includes a pair of holes (not shown) to receive the posts 312 therethrough. The display board 304 includes a display 60 and associated control circuitry 314. The control circuitry 314 can process the signals sent to the tag 20 and control the display outputted on the display 60.

The display control circuitry 314 includes a pair switch contacts 316, 318. The switch contact 316 includes an "E" shaped conductor 323 that is interleaved with another "E" shaped conductor 325. The conductor 323 is electrically isolated from the conductor 325. Similarly, the switch contact 318 includes a pair of interleaved "E" shaped circuits 327, 329. The switch plates 306 are installed over the associated switch contacts 316, 318 such that the switch may complete the connection between each interleaved "E" circuit in each switch contact 316, 318, as will be discussed in greater detail below.

The protective overlay 57 is preferably a 0.002 inch thick sheet of clear polyester with a 0.001 inch thick over coat of clear hard coat laminate applied thereto. A thin layer of pressure sensitive adhesive may be applied to the back surface of the overlay 57. The opaque portion 55 of the overlay may be painted or applied onto the overlay 57 to form a "frame". Other textual information or labels can be printed on the opaque frame portion 55 as is desired by the manufacturer. The overlay 57 also preferably includes a clear portion 53, or "window" for viewing the display 60 therethrough. In an alternate embodiment, the overlay 57 is a thin, opaque layer of PVC, and the overlay has a cut-out to form the window through which the display 60 may be viewed. The protective overlay 57 is applied over the combination of the display board 304, the switch plates 306, and the bobbin assembly 302 so as to hold together the internal components of the display tag 20 and to seal the display tag 20 with respect to electrostatic discharge (ESD) and/or fluids, cleansing solutions, and the like.

Figure 35:
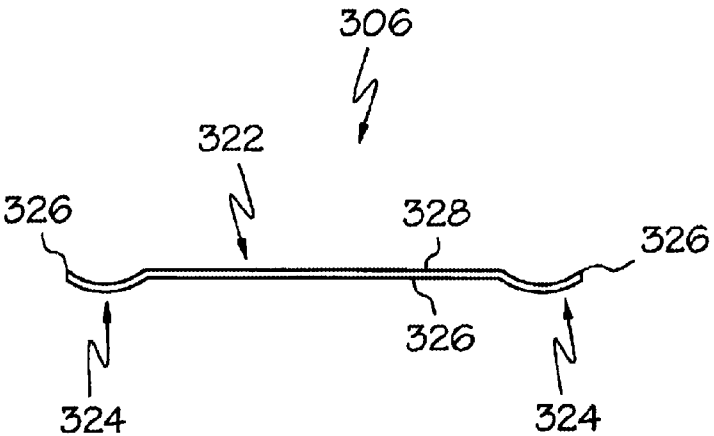
FIG. 35 is a side view of the switch of FIG. 34.
Figure 34:
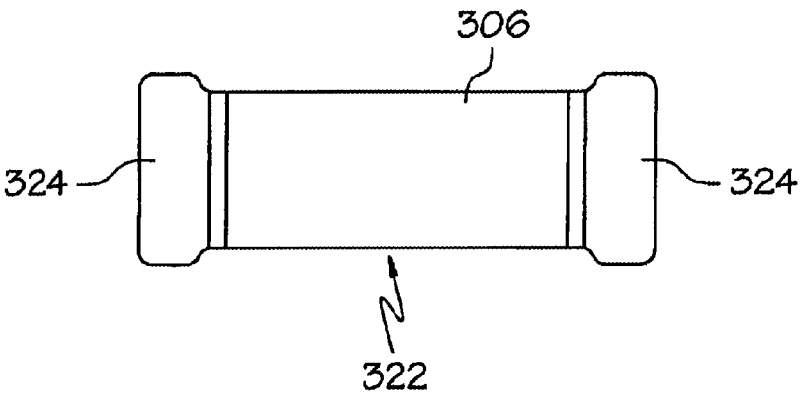
FIG. 34 is a top view of a switch of the tag of FIG. 32.
Figure 36:
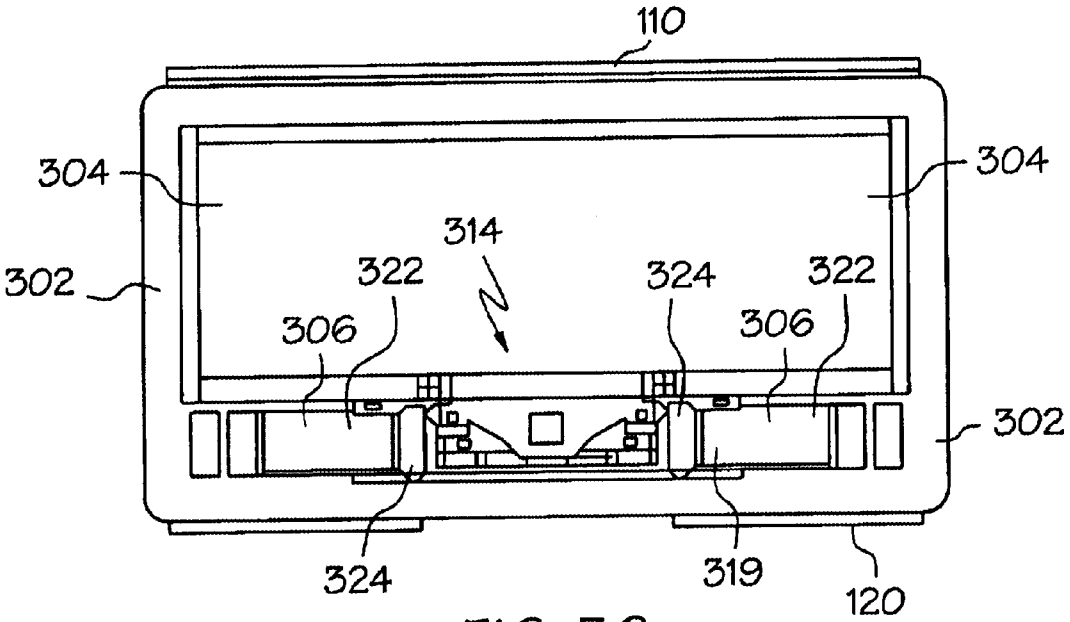
FIG. 36 is a front view of the tag of the present invention.

As shown in FIGS. 34–35, each switch plate 306 includes a rectangular flat portion 322 and a pair of arcuate contact portions 324 extending from the lateral sides of the rectangular portion 322. The switch plate 306 is made from a conductive material, and is preferably stamped from 0.01 inch thick, zinc plated 1050 spring steel. The radius of the arcuate contact portions 324 are preferably approximately 0.03 inches, and the lateral ends 326 of each arcuate portion 324 are preferably substantially flush with the top surface 328 of the rectangular portion 322.

Figure 33:
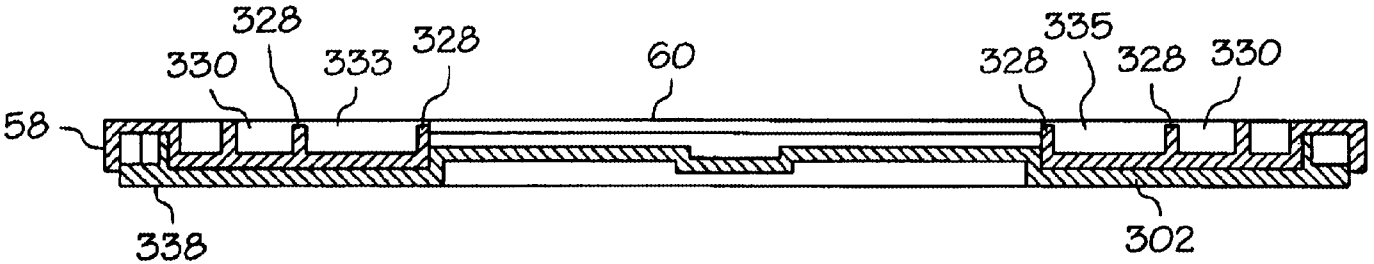
FIG. 33 is a cross sectional side view of the bobbin assembly of the tag of FIG. 32.
Figure 37:
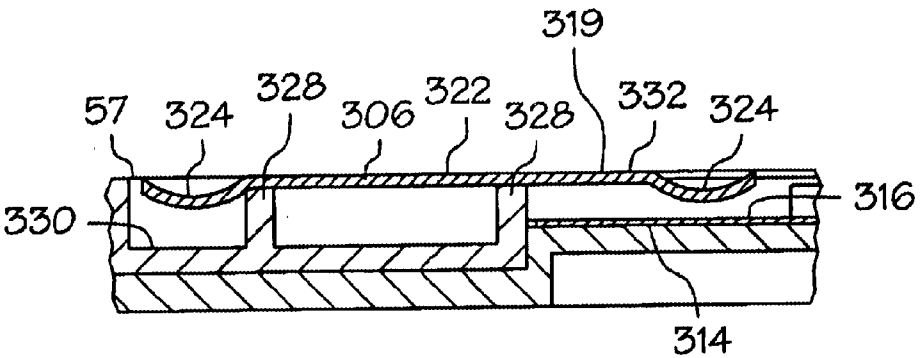
FIG. 37 is a detail, side cross sectional view of the tag of FIG. 36.

As shown in FIGS. 32–33, the bobbin assembly 302 includes a set of vertical support bars 328 on opposing sides of the bobbin assembly 302. The display board 304 is received in the bobbin assembly 302 such that the switch contacts 316, 318 are located in the spaces 333, 335 on the bobbin assembly 302. The left switch plate 306 and its interaction with the switch contact 316 is illustrated in FIG. 37, and the right switch plate 306 and its interaction with the switch contact 318 is substantially identical. When the switch plate 306 is mounted within the bobbin assembly 302, as shown in FIG. 37, the rectangular portion 322 of the switch plate 306 is supported on the vertical support bars 328. The switch plate 306 is positioned on the support bars 328 such that one of the arcuate contact portions 324 overhangs the associated switch contact 316 of the display circuit 314. The opposing arcuate portion is positioned within a cut out 330 adjacent outermost support bar 328.

When the overlay 57 is applied over the switch plates 306, the display board 304, and the bobbin assembly 302, the switch plates 306 are held securely against the support bars 328. When it is desired to trigger the tag 20 to send a signal to the system controller 28, the one or both of the switches 306 are used to complete the circuits between the interleaved circuits 323, 325 of contact 316, or interleaved circuits 327, 329 of switch contact 318. In order to complete the circuits to send a signal, the user applies pressure to the portion 332 of the overlay 57 which covers the over hanging portion 319 of the switch plates 306. The pressure is transmitted to the over hanging portion 319, which causes the overhanging portion 319 and associated arcuate contact portion 324 of the switch plate 306 to flex downwardly and contact the switch contacts 316, 318 of the display control circuitry 314. When the arcuate portion 324 contacts a switch contact 316, 318, it acts as a conductor and closes the circuit between the two interleaved "E" circuits in the switch contact 316, 318 (FIG. 32). When the circuit is closed, a signal may be sent to the system controller 28. When pressure is removed from the area 332 of the overlay 57, the over hanging portion 319 of the switch plate 306 will spring back into the orientation shown in FIG. 37, thereby opening the circuit and thus deactivating the switch.

Contact switches 306 preferably have symmetrically opposed arcuate portions 324 so that the switches 306 can be installed in the tag 20 in either orientation. In one embodiment, each switch plate 306 has a protruding bulb located above the arcuate contact portion 324. The bulb bulges at the portion 332 of the overlay 57 located above the contact portion to communicate to the user, by sight and/or touch, the location of the arcuate contact portion 324.

The "switching" function of the switches 306 and switch contacts 316, 318 may be useful in order to identify a tag 20 that is to display information for a certain product, as discussed earlier, or for other purposes beyond those specifically discussed herein.

Figure 38:
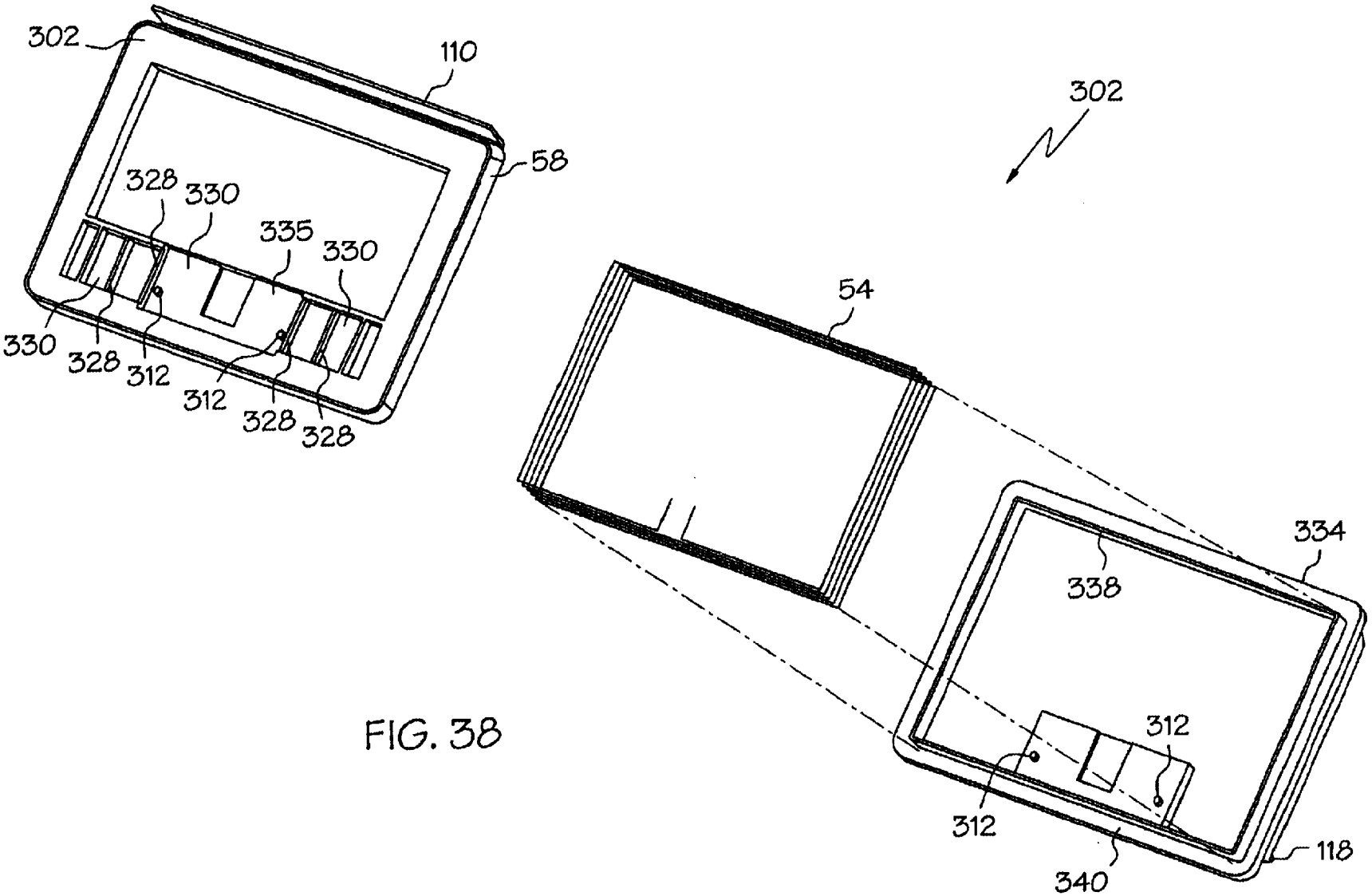
FIG. 38 is an exploded, perspective view of the bobbin assembly of the tag of FIG. 32.

As shown in FIG. 38, the bobbin assembly 302 is comprised of several subassemblies, including an inner bobbin 334, the pick up coil 54 and the plastic or polymeric overmold 58. The inner bobbin 334 is preferably injection molded plastic and includes a rectangular ridge 338 positioned substantially about an outer periphery thereof. The ridge 338 is provided for receiving the pick up coil 54 thereabout. The pick up coil 54 can either be wound onto the ridge 338, or the coil 54 can be air wound separately as a generally rigid structure and then placed onto the rectangular ridge 338. The inner bobbin 334 also includes the projection 118 extending from a rear face thereof. As discussed earlier, the projection 118 is provided for a vertical registration of the display tag 20 within the auxiliary rail 56. Once the pick up coil 54 is installed onto the inner bobbin 334, the coil 54 and inner bobbin 334 are placed in a mold into which molten plastic is injected. In filling the mold, the injected plastic encapsulates the coil 54 and forms the overmold 58 of the bobbin assembly 302. The overmold 58 may also be fabricated using extrusion molding or sheet molding techniques as are known to those of ordinary skill in the art. By utilizing such overmolding techniques, the coil 54 of the display tag 20 is substantially sealed from fluids and small food particles, and the injection molded plastic helps to retain the pick up coil 54 in place. The overmold 58 also includes the flexible tab 110 used to lock the tag 20 into the auxiliary rail, and the downwardly extending bosses 120 used for the horizontal registration of the tag 20 as described above.

Figure 41:
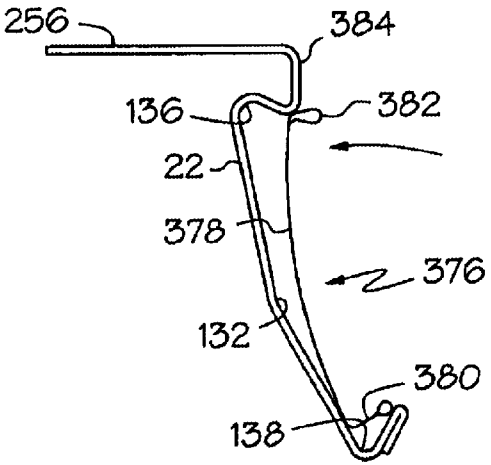
FIG. 41 is a side view of the attachment body and shelf edge of FIG. 40, with the attachment body being uncoupled from the shelf edge.
Figure 40:
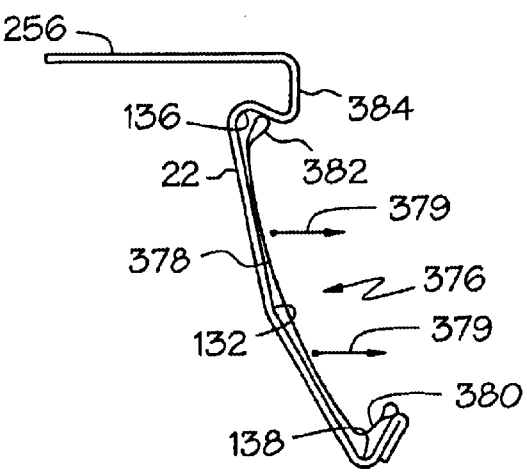
FIG. 40 is a side view of the attachment body of FIG. 39 received in another shelf edge.
Figure 39:
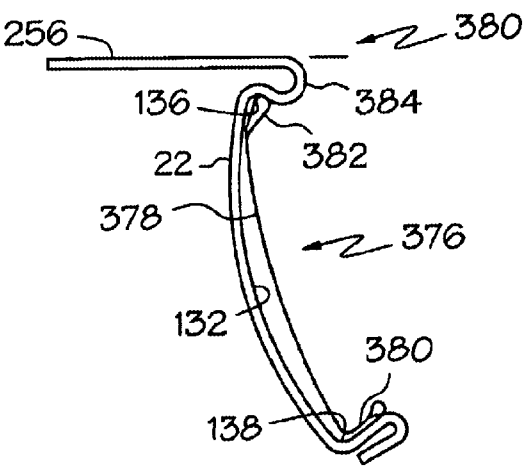
FIG. 39 is a side view of an attachment body received in a shelf edge.

FIGS. 39–41 show another apparatus for attaching an auxiliary rail 56 to a shelf edge 22. The attachment body 376 including a pair of generally flexible, co-extruded ends 380, 382 received in the shelf edge 22. The upper tip 382 is received in the upper groove 136 of the shelf edge 22, and the lower tip 380 is received in the lower groove 138. The central body 376 may be directly coupled to an auxiliary rail 56 so that the auxiliary rail 56 may be directly coupled to the shelf edge 22. Alternately, the central body 376 may be part of a bracket that extends a partial or full length of the shelf edge 22. The bracket may then include some means for receiving an auxiliary rail thereon, including but not limited to an upper and lower tang.

The attachment body 376 includes a somewhat bowed middle segment 378 and a lower tip 380 comprising a generally short "L" shaped foot extending forwardly and slightly upwardly from the bottom of the bowed segment 378. The lower tip 380 helps to account for height variations with the shelf edges 22. The lower tip 380 also facilitates the retainment of the attachment body 376 to the shelf edge 22. When the attachment body 376 is attempted to be removed from the shelf edge 22 due to the application of pull forces 379 (as shown in FIG. 40), the middle segment 378 pivots upwardly. This tend to straighten the middle segment, and increases the force at the tips 380, 382. This binds the attachment body 376 even tighter within the shelf edge 22.

The upper tip 382 is preferably biased upwardly. As the attachment body 376 is being installed into the tag slot 132, the upper tip 382 flexes downwardly (FIG. 41) so that the attachment body 376 can pass by the outward projecting edge 384 of the shelf. Once the attachment body 376 is received into the shelf edge 22, the upper tip 382 flexes upwardly to contact the inner surface of the C-shaped tag slot to retain the attachment body 376 within the C-shaped tag slot, in a cam-over fashion (FIG. 40). When the attachment body 376 is seated within the shelf edge 22, it preferably has four points of contact with the shelf edge 22. The upper tip 382 provides two points of contact, and the lower tip 380 provides another two points of contact. The four points of contact lend additional stability to the body 376, and enable it to accommodate varying sizes of shelf edges 22.

While the forms of the apparatus described herein constitute a preferred embodiment of the invention, the present invention is not limited to the precise forms described herein, and changes may be made therein without departing from the scope of the invention.

What is claimed is:

1. An electronic display tag attachment system, comprising:

a rail for receiving an electronic display tag therein, the rail including:

a backing having a top edge and a bottom edge;

an upper flange extending from said top edge;

a lower flange extending from said bottom edge, said upper and lower flanges defining a channel therebetween for receiving a tag therein; and a plurality of spaced protrusions extending into said channel to block significant lateral movement of a tag positioned in said channel along a length of said rail, each protrusion being spaced apart from any adjacent protrusions.

2. The system of claim 1 wherein each protrusion extends generally upwardly from said lower flange.

3. The system of claim 1 wherein each protrusion is unitary with said lower flange.

4. The system of claim 1 wherein each protrusion has a surface that extends generally away from one of said top or bottom flanges and generally perpendicular to any lateral movement of said tag to block significant lateral movement of said tag.

5. The system of claim 1 wherein each protrusion is generally rectangular in top and side view.

6. The system of claim 1 wherein at least one of said flanges is generally flexible such that said at least one flange can be displaced so that said channel can receive a tag therein.

7. The system of claim 1 wherein said upper flange includes a downwardly extending lip shaped to retain a tag in said rail, and wherein said lower flange includes an upwardly extending lip shaped to retain a tag in said rail.

8. The system of claim 1 wherein said rail further includes a lower clip adjacent said lower edge, said lower clip being shaped to receive and retain sheet-like articles therein.

9. The system of claim 1 further comprising a tag having a back side and a projection on its back side and a conductive coil therein, wherein said backing includes a conductive loop therealong, and wherein said rail is shaped to receive said tag and wherein said backing includes a recessed area shaped to cooperate with said tag projection to locate said conductive coil of said tag adjacent said conductive loop.

10. The system of claim 9 wherein said conductive coil of said tag extends around a perimeter of said tag.

11. The system of claim 1 further comprising a tag having a recess which receives at least one of said rail protrusions.

12. The system of claim 11 wherein each rail protrusion extends from said lower flange, and wherein said tag recess is located adjacent said lower flange.

13. The system of claim 12 wherein said tag recess is located on a bottom surface of said tag.

14. The system of claim 12 wherein said tag recess has a length greater than a length of at least one of said rail protrusions.

15. The system of claim 12 wherein said tag recess is formed by a pair of opposed generally vertically extending walls, each wall having a surface that extends generally perpendicular to any lateral movement of said tag to block lateral movement of said tag along said rail a distance that is greater than a lateral width of said tag.

16. The system of claim 1 further comprising a tag having a body with a front surface for displaying information, said body including a first boss for cooperating with one of said rail protrusions to thereby block significant lateral movement in a first direction of said tag within said channel.

17. The system of claim 16 wherein said first boss extends generally outwardly from said body, and wherein said body further includes a second generally outwardly extending boss laterally spaced from said first boss in a direction along a length of said rail, wherein said second boss is located to allow at least one of said rail protrusions to be received between said first boss and said second boss.

18. The system of claim 17 wherein at least one of said rail protrusions cooperates with said second boss to block significant lateral movement of said tag in a second direction in said channel.

19. The system of claim 16 wherein each rail protrusion extends generally upwardly from said lower flange, and wherein said first boss extends generally downwardly from said tag body.

20. The system of claim 1 further comprising a tag comprising a body having an edge surface, a front surface for displaying information, and a tab extending from said edge surface, said tab being shaped to be received in said upper flange or said lower flange of said rail when said body is received in said channel to thereby retain said tag in said channel.

21. The system of claim 20 wherein said flange receiving said tab includes an inwardly extending lip shaped to retain said tab therein when said tag is received in said channel.

22. The system of claim 21 wherein said flange receiving said tab is flexible such that said flange is deflected when said tab is pushed past said flange receiving said tab.

23. The system of claim 20 wherein said tab is flexible such that said tab is deflected when said tab is pushed past said flange receiving said tab.

24. The system of claim 20 wherein said tab extends generally along the entire length of said tag.

25. The system of claim 20 wherein said edge surface is said upper surface of said tag, and wherein said tab extends generally forwardly and upwardly relative said upper surface, and wherein said receiving flange is said upper flange.

26. The system of claim 1 wherein said rail includes a back side and an upper and a lower slot on the back side of said rail, said upper and lower slots being shaped to receive an upper and lower tang of a coupling body therein, respectively.

27. The system of claim 11 wherein said tag has a top surface shaped to be located adjacent to said upper flange, a bottom surface shaped to be located adjacent to said lower flange, and a pair of generally vertically extending sides, each side extending between said top surface and said bottom surface, and wherein said recess is spaced away from both of said sides.

28. The system of claim 4 wherein each protrusion has an auxiliary surface that extends generally perpendicular to any lateral movement of said tag, wherein said auxiliary surface is laterally spaced apart from and generally parallel to said surface.

29. The system of claim 4 wherein each surface is oriented generally vertically.

30. The system of claim 1 wherein each protrusion is spaced apart by a distance of at least a width of said protrusions, said width being measured in said lateral direction.

31. An electronic display tag attachment system, comprising:

a rail for receiving an electronic display tag therein, the rail including:

a backing having a top edge and a bottom edge;

an upper flange extending from said top edge;

a lower flange extending from said bottom edge, said upper and lower flanges defining a channel therebetween for receiving a tag therein; and a plurality of protrusions extending into said channel and along a length of said channel, at least one of said protrusions having an end surface spaced away from an end surface of said rail that extends generally perpendicular to any lateral movement of said tag to engage said tag and block significant lateral movement of said tag along a length of said rail, each protrusion being laterally spaced apart from any adjacent protrusions.

32. The system of claim 31 further comprising a tag having a recess which receives at least one of said protrusions therein, wherein said tag has a top surface shaped to be located adjacent to said upper flange, a bottom surface shaped to be located adjacent to said lower flange, and a pair of generally vertically extending sides, each side extending between said top surface and said bottom surface, and wherein said recess is spaced away from both of said sides.

33. The system of claim 31 wherein said end surface of said at least one of said protrusions is oriented generally vertically.

34. The system of claim 31 wherein said end surface of said at least one of said protrusions extends generally away from one of said top or bottom edges and generally perpendicular to any lateral movement.

35. The system of claim 31 wherein said at least one protrusion has an auxiliary surface that extends generally perpendicular to any lateral movement of said tag, wherein said auxiliary surface is laterally spaced apart from and generally parallel to said end surface of said at least one protrusion.

36. The system of claim 31 wherein each protrusion is spaced apart by a distance of at least a width of said protrusions, said width being measured in said lateral direction.

37. An electronic display tag attachment system, comprising:

a rail for receiving an electronic display tag therein, the rail extending in a longitudinal direction and including:

a backing having a top edge and a bottom edge;

an upper flange extending from said top edge;

a lower flange extending from said bottom edge, said upper and lower flanges defining a channel therebetween for receiving a tag therein; and a plurality of spaced protrusions extending into said channel to block significant lateral movement of a tag positioned in said channel along a length of said rail, each protrusion having an end surface which extends perpendicular to said longitudinal direction of said rail.

38. An electronic display tag attachment system, comprising:

a rail for receiving an electronic display tag therein, the rail extending in a longitudinal direction and including:

a backing having a top edge and a bottom edge;

an upper flange extending from said top edge;

a lower flange extending from said bottom edge, said upper and lower flanges defining a channel therebetween for receiving a tag therein; and a protrusion extending into said channel and along a length of said channel, said protrusion having an end surface spaced away from an end surface of said rail that extends generally perpendicular to any lateral movement of said tag and to said longitudinal direction to engage said tag and block significant lateral movement of said tag along a length of said rail in said longitudinal direction.

* * * * *